US007498948B1

(12) United States Patent
Gudeman et al.

(10) Patent No.: US 7,498,948 B1
(45) Date of Patent: Mar. 3, 2009

(54) ELECTRONIC ARTICLE SURVEILLANCE (EAS) TAG/DEVICE WITH COPLANAR AND/OR MULTIPLE COIL CIRCUITS, AN EAS TAG/DEVICE WITH TWO OR MORE MEMORY BITS, AND METHODS FOR TUNING THE RESONANT FREQUENCY OF AN RLC EAS TAG/DEVICE

(75) Inventors: Christopher Gudeman, Los Gatos, CA (US); J. Devin MacKenzie, San Carlos, CA (US); J. Montague Cleeves, Redwood City, CA (US); Jose Arreola, Mountain View, CA (US)

(73) Assignee: Kovio, Inc., Milpitas, CA (US)

( * ) Notice: Subject to any disclaimer, the term of this patent is extended or adjusted under 35 U.S.C. 154(b) by 0 days.

(21) Appl. No.: 11/900,365

(22) Filed: Sep. 10, 2007

Related U.S. Application Data

(63) Continuation of application No. 11/104,375, filed on Apr. 11, 2005, now Pat. No. 7,286,053.

(60) Provisional application No. 60/592,596, filed on Jul. 31, 2004.

(51) Int. Cl.
*G08B 13/14* (2006.01)

(52) U.S. Cl. ..... 340/572.8; 340/572.1; 340/572.7

(58) Field of Classification Search ..... 340/572.8, 340/572.1, 572.7; 235/492; 257/679
See application file for complete search history.

(56) References Cited

U.S. PATENT DOCUMENTS 4,063,229 A 12/1977 Welsh et al.
4,223,830 A 9/1980 Walton
4,498,076 A 2/1985 Lichtblau
4,567,473 A 1/1986 Lichtblau
4,666,735 A 5/1987 Hoover et al.
4,728,938 A 3/1988 Kaltner
5,030,940 A 7/1991 Siikarla
5,081,445 A 1/1992 Gill et al.
5,099,225 A 3/1992 Narlow et al.
5,111,186 A 5/1992 Narlow et al.
5,218,189 A 6/1993 Hutchison
5,257,009 A 10/1993 Narlow (Continued)

OTHER PUBLICATIONS

Michael Fitzgerald; The Sound and the Fury; Apr. 1, 2004; 5 Pages; http://story.news.yahoo.com/news?tmpl=story&u=/ttzd/20040401/tc_techtues_zd/.

*Primary Examiner*—John A Tweel, Jr.
(74) *Attorney, Agent, or Firm*—Andrew D. Fortney

(57) ABSTRACT

An EAS device, and methods for making the device for tuning the resonant frequency of the same is disclosed. The EAS device includes: an outer inductor having one end coupled to a linear or nonlinear capacitor plate; an inner inductor having one end coupled to the other type of capacitor; a first dielectric film on the outer and inner inductors and the capacitor plates coupled thereto, having openings exposing other ends of the outer and inner inductors; a second linear capacitor plate on the dielectric film; a second nonlinear capacitor plate on the dielectric film; a second dielectric film containing holes for the second linear and nonlinear capacitor plates, and exposing the other ends of the first and second inductors; and first and second conducting straps on the second dielectric film, configured to electrically connect one of the exposed inductor ends to a corresponding second capacitor plate.

25 Claims, 12 Drawing Sheets

U.S. PATENT DOCUMENTS

| | | | |
|---|---|---|---|
| 5,510,769 | A | 4/1996 | Kajfez et al. |
| 5,541,604 | A | 7/1996 | Meier |
| 5,608,379 | A | 3/1997 | Narlow et al. |
| 5,625,341 | A | 4/1997 | Giles et al. |
| 5,841,350 | A | 11/1998 | Appalucci et al. |
| 5,861,809 | A | 1/1999 | Eckstein et al. |
| 6,087,940 | A | 7/2000 | Caperna et al. |
| 6,091,607 | A | 7/2000 | McKeown et al. |
| 6,177,870 | B1 | 1/2001 | Lian et al. |
| 6,313,747 | B2 | 11/2001 | Imaichi et al. |
| 6,356,197 | B1 | 3/2002 | Patterson et al. |
| 6,400,271 | B1 | 6/2002 | Davies, Jr. et al. |
| 6,535,108 | B1 | 3/2003 | Schrott et al. |
| 6,693,541 | B2 | 2/2004 | Egbert |
| 6,736,918 | B1 | 5/2004 | Ichikawa et al. |
| 6,919,806 | B2 | 7/2005 | Narlow et al. |
| 7,109,867 | B2 | 9/2006 | Forster |
| 7,113,131 | B2 | 9/2006 | Burke |
| 7,152,804 | B1 | 12/2006 | MacKenzie et al. |
| 7,286,053 | B1 * | 10/2007 | Gudeman et al. ..... 340/572.1 |
| 2001/0040507 | A1 | 11/2001 | Eckstein et al. |
| 2002/0163434 | A1 | 11/2002 | Burke |
| 2003/0108664 | A1 | 6/2003 | Kodas et al. |
| 2004/0053431 | A1 | 3/2004 | Chang et al. |
| 2005/0026317 | A1 | 2/2005 | Sirringhaus et al. |
| 2005/0181566 | A1 | 8/2005 | Machida et al. |

* cited by examiner

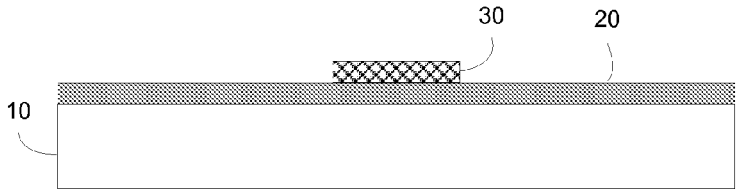
FIG. 4A
FIG. 4B
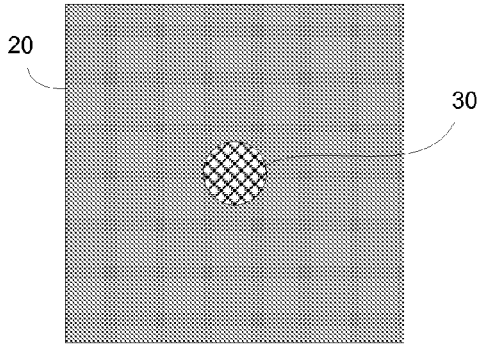
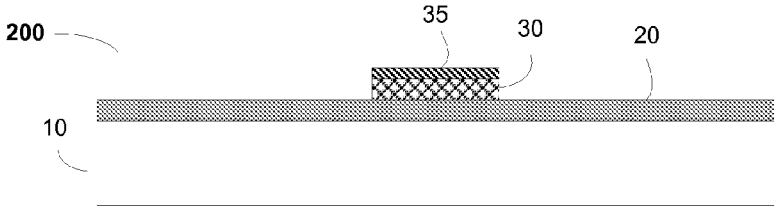
FIG. 5A
FIG. 5B
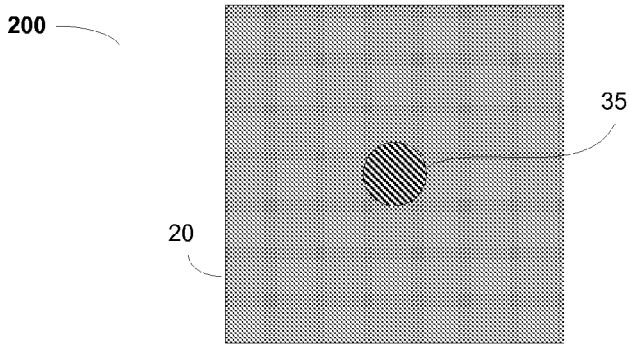

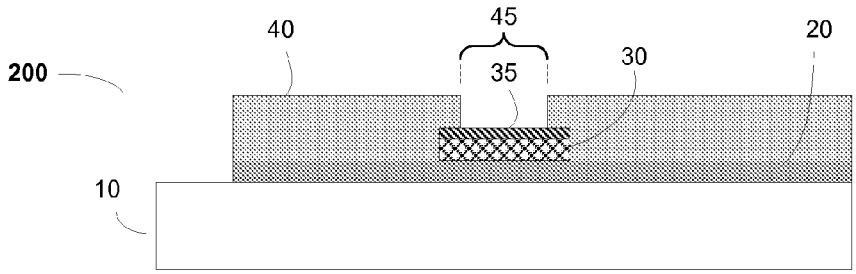
FIG. 6A
FIG. 6B
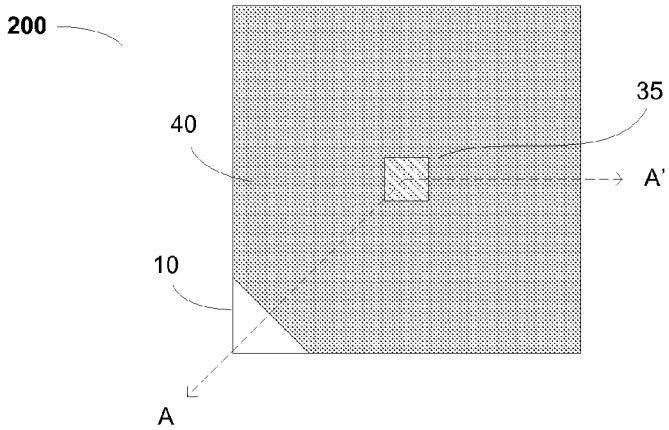
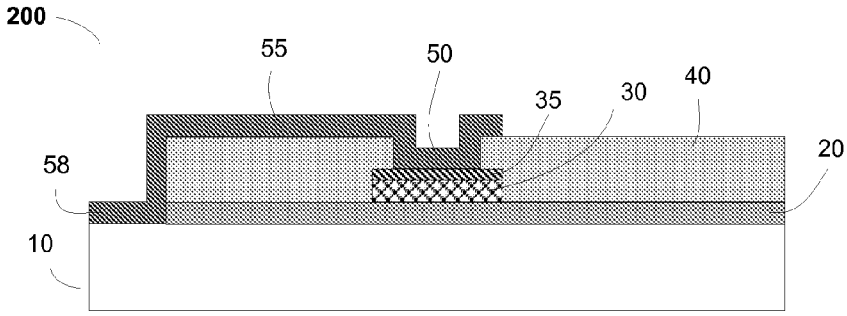
FIG. 7A

ELECTRONIC ARTICLE SURVEILLANCE (EAS) TAG/DEVICE WITH COPLANAR AND/OR MULTIPLE COIL CIRCUITS, AN EAS TAG/DEVICE WITH TWO OR MORE MEMORY BITS, AND METHODS FOR TUNING THE RESONANT FREQUENCY OF AN RLC EAS TAG/DEVICE

RELATED APPLICATIONS

This application is a continuation of U.S. patent application Ser. No. 11/104,375, filed Apr. 11, 2005 now U.S. Pat. No. 7,286,053, which claims the benefit of U.S. Provisional Application No. 60/592,596, filed Jul. 31, 2004, which is incorporated herein by reference in its entirety.

FIELD OF THE INVENTION

The present invention generally relates to the field of electronic article surveillance (EAS), radio frequency (RF) and/or RF identification (RFID) tags and devices. More specifically, embodiments of the present invention pertain to EAS tags with coplanar and/or multiple coil circuits, EAS tags with two or more memory bits, and methods for tuning the resonant frequency of an RLC EAS tag.

DISCUSSION OF THE BACKGROUND

The detection range of an electronic article surveillance (EAS) tag that is based on resonant resistor-inductor-capacitor (RLC) circuits is limited by the magnetic flux that is available at the coil or inductor of the tag from the reader transceiver. This is particularly problematic for RF tags designed to generate frequency division signals so as to divide a broadcast or carrier frequency. These tags generally require a minimum RF field in order to activate the frequency division signal. Further, Federal Communications Commission (FCC) regulations on the amount of RF field that can be broadcast by a tag reader also limit the read range, a key specification parameter for an RF EAS or RFID system.

One way to generate a frequency division signal in a tag is to have a circuit containing an inductor in parallel with a nonlinear capacitance element, such as a MOS capacitor or diode, which is tuned to a frequency that is a factor of two away from the broadcast or carrier frequency. Since the nonlinear tag resonance or resonant frequency is away from the carrier frequency, the amount of signal coupled into the nonlinear coil may be relatively low.

In other approaches, the local flux and carrier signal coupling into the tag can be greatly enhanced by employing two RLC circuits in the tag, such that: (1) the first resonates at the reader broadcast frequency (F); (2) the second resonates at the reader sensing frequency (F/N), where N is typically 2, but N can be an integer higher than 2; and (3) the coils of the two RLC circuits are in close proximity to each other so that the resonance enhancement of the reader broadcast field by the first RLC circuit couples effectively into the second RLC circuit. However, due to coupling and mutual inductance effects, bringing two inductive coils into close proximity may shift the resonances to new frequencies as compared to their separate individual resonances. In this case, the coil that is tuned to the higher broadcast frequency tends to shift to higher frequencies and the coil that is tuned to the lower sensing frequency tends to shift to lower frequencies.

An EAS and/or RFID system operating at 13.56 MHz operation is of particular interest, considering the high field levels allowed by the FCC and other international regulatory agencies at this frequency. However, the bandwidth of the 13.56 MHz carrier signal allowed by the regulations is typically very small (e.g., about 14 kHz). For practical purposes, this dictates that the tag must be tuned to the essentially single-valued carrier frequency.

Generally speaking, the cost to manufacture two RLC circuits using pre-existing EAS and/or RFID tag technology is twice that of a single circuit. Accordingly, it is desirable to obtain a design and method of manufacturing a two (or more) coil circuit that costs essentially the same as that of a single coil circuit.

In commercial applications, an EAS tag/device typically deactivates its RF functionality when the article is legally purchased. This is generally referred to as a "write-once" single bit memory. If more bits of write-once memory were available in the EAS tag, store owners could determine, for example, whether an article had been purloined at a receiving dock (e.g., by an employee) or from a store aisle (e.g., by a customer). Thus, there are applications and a need for an EAS and/or RF tag having more than one bit of write-once memory.

Also, it is generally very difficult and costly to hold tight tolerances on the capacitor in an RLC resonant circuit of an RF electronic surveillance tag during a low cost manufacturing process. Accordingly, a capability or means for tuning the circuit after assembly would be advantageous so that capacitor manufacturing tolerances could be loosened and the overall process cost reduced.

One challenge to allowing reduced tolerances in low cost EAS tag manufacturing lies in matching the resonant frequency of an RLC circuit to a fixed frequency of an RF reader system, such as may be installed at the exit of a store or library, for example. As described above, this fixed frequency is generally very tightly controlled by the FCC (e.g., 13.56+/−0.01 MHz). Optimum tuning of an RLC circuit of the EAS tag would then require that the LC product be controlled to within 1.4%. It would also be desirable to have a design that allows the LC product tolerance to be substantially expanded to accommodate more cost-effective manufacturing processes.

SUMMARY OF THE INVENTION

Embodiments of the present invention relate to an electronic article surveillance (EAS) tag/device with coplanar and/or multiple coil circuits, and EAS tag/device with two or more memory bits, and methods for making the tag/device and/or for tuning the resonant frequency of an RLC EAS tag/device.

The surveillance and/or identification device generally includes: (a) an outer inductor having a first end coupled to a first plate of one of a linear capacitor or a nonlinear capacitor; (b) an inner inductor having a first end coupled to a first plate of the other of the linear capacitor or the nonlinear capacitor; (c) a first dielectric film on the outer inductor, the inner inductor, and the linear and nonlinear capacitor plates to which they are coupled, the first dielectric film having openings therein exposing second ends of the respective outer and inner inductors; (d) a second linear capacitor plate on the dielectric film, coupled to the first linear capacitor plate, (e) a second nonlinear capacitor plate on the dielectric film, coupled to the first nonlinear capacitor plate, (f) a second dielectric film containing holes therein for the second linear and nonlinear capacitor plates, and exposing second ends of each of the first and second inductors, and (g) conducting straps (which may be printed) on the second dielectric film, each configured to electrically connect one of the second inductor ends to a corresponding second capacitor plate. The nonlinear capacitor can further include a semiconductor component on the dielectric film. The device may further comprise a third (or further) inductor, capacitor coupled thereto and strap therebetween.

The method of manufacture generally includes the steps of: (1) depositing a semiconductor material or semiconductor material precursor on a first, relatively thin dielectric film, the thin dielectric film being on an electrically conducting substrate; (2) forming a semiconductor component from the semiconductor material or semiconductor material precursor; (3) forming a second, relatively thick dielectric film on the thin dielectric and the semiconducting component, the second dielectric film having holes therein to facilitate electrical connection, (4) forming at least two conductive structures, a first one of which is at least partly on the semiconductor component and which comprises a first electrically conducting strap configured to provide electrical communication between the semiconductor component and the electrically functional substrate, and a second one of which comprises a second electrically conducting strap configured to provide electrical communication between a linear capacitor plate and the electrically functional substrate; and (5) etching the electrically functional substrate to form an inner inductor and an outer inductor. Alternatively, the second dielectric film may be formed on the thin dielectric, the second dielectric film having holes therein (e.g., to facilitate subsequent formation of and electrical connection to at least one linear capacitor plate and one nonlinear capacitor plate), then the semiconducting component for the nonlinear capacitor plate may be formed in a corresponding hole in the second dielectric film.

The method of tuning generally includes the steps of: (1) forming a conductive structure configured to provide electrical communication between a capacitor plate of a surveillance and/or identification device and an electrically functional substrate; and (2) etching the electrically functional substrate to form an inductor and an electromagnetically active inner plug or ring with dimensions and/or a location sufficient to shift a resonant frequency. Thus, the surveillance and/or identification device can be tuned by locating the inner inductor such that a resonant frequency of the outer inductor increases by a desired amount, relative to locating the inner inductor in the geometric center of the outer inductor. Alternatively, tuning may include placement of a conductive plug or ring in an appropriate spot on the passivation layer at the completion of manufacture, or formation of a conductive plug or ring in an appropriate or predetermined location in an inductor, generally at the same time that the inductor is formed (i.e., during the substrate etching step).

The present invention advantageously provides a low cost EAS, RF and/or RFID tag having increased detection range using two or more RLC circuits, more than one bit of write-once memory capability, and/or resonant frequency tuning capability after assembly. These and other advantages of the present invention will become readily apparent from the detailed description of preferred embodiments below.

BRIEF DESCRIPTION OF THE DRAWINGS

FIGS. 4A and 4B show cross-sectional and top views, respectively, of the substrate of FIGS. 3A-3B with a first semiconductor component layer printed on the anodized aluminum oxide film.

FIGS. 5A and 5B show cross-sectional and top views, respectively, of the substrate of FIGS. 4A-4B with a second semiconductor component layer on the first semiconductor component layer.

FIGS. 6A and 6B show cross-sectional and top views, respectively, of the substrate of FIGS. 5A-5B with an interlayer dielectric thereon.

FIGS. 7A and 7B show cross-sectional and top views, respectively, of the substrate of FIGS. 6A-6B with a conductive structure thereon.

FIGS. 10A and 11B show cross-sectional and top views, respectively, of the alternative embodiment of FIGS. 10A-10B with a semiconductor component in a via in the interlayer dielectric.

DETAILED DESCRIPTION OF THE PREFERRED EMBODIMENTS

Figure 1A:
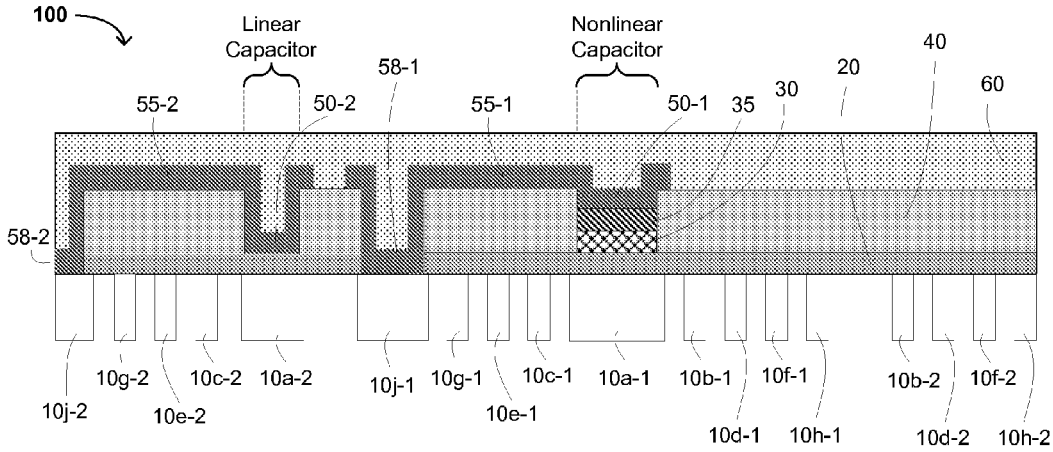
FIG. 1A shows a cross-sectional view of an exemplary dual coil embodiment of the present tag/device.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention.

For the sake of convenience and simplicity, the terms "coupled to," "connected to," and "in communication with" mean direct or indirect coupling, connection or communication unless the context indicates otherwise. These terms are generally used interchangeably herein, but are generally given their art-recognized meanings. Also, for convenience and simplicity, the terms "surveillance," "EAS," "RF," "RFID," and "identification" may be used interchangeably with respect to intended uses and/or functions of a device and/or tag, and the term "EAS tag" or "EAS device" may be used herein to refer to any EAS, RF and/or RFID tag and/or device. In addition, the terms "item," "object" and "article" are used interchangeably, and wherever one such term is used, it also encompasses the other terms. In the present disclosure, the phrase "consisting essentially of," when used in the context of a conductor, a semiconductor, a Group IVA element (such as silicon), or a dielectric (such as silicon dioxide or aluminum oxide) does not exclude intentionally added dopants, which may give the material certain desired (and potentially quite different) electrical properties. Also, a "major surface" of a structure or feature is a surface defined at least in part by the largest axis of the structure or feature (e.g., if the structure is round and has a radius greater than its thickness, the radial surface[s] is/are the major surface of the structure).

In one aspect, the present invention concerns a surveillance and/or identification device, generally including: (a) an outer inductor having a first end coupled to a first plate of one of a linear capacitor or a nonlinear capacitor; (b) an inner inductor having a first end coupled to a first plate of the other of the linear capacitor or the nonlinear capacitor; (c) a dielectric film on the outer inductor, the inner inductor, and the first linear and nonlinear capacitor plates coupled thereto, the first dielectric film having openings therein exposing second ends of the respective outer and inner inductors; (d) a second linear capacitor plate on the dielectric film, coupled to the first linear capacitor plate; (e) a second nonlinear capacitor plate on the dielectric film, coupled to the first nonlinear capacitor plate; (f) a second dielectric film containing holes therein for the second linear capacitor plate and the second nonlinear capacitor plate, and exposing second ends of each of the first and second inductors, and (g) conducting straps (which may be printed) on the second dielectric film, each configured to electrically connect one of the second inductor ends to a corresponding second capacitor plate. The second nonlinear capacitor plate can further include a semiconductor component on the dielectric film. The device may further comprise a third (or further) inductor, capacitor coupled thereto and strap therebetween.

In a further aspect, the present invention concerns a method of manufacture, generally including the steps of: (1) depositing a semiconductor material or semiconductor material precursor on a first, relatively thin dielectric film, the first dielectric film being on an electrically conducting substrate; (2) forming a semiconductor component from a semiconductor material or semiconductor material precursor; (3) forming a second, relatively thick dielectric film on the thin dielectric and the semiconducting component, the second dielectric film having holes therein to facilitate electrical connection (and/or coupling) to the semiconductor component and certain portions of the substrate, (4) forming at least two conductive structures, a first one of which is at least partly on the semiconductor component and which comprises a first electrically conducting strap configured to provide electrical communication between the semiconductor component and the electrically functional substrate, and a second one of which comprises a second electrically conducting strap configured to provide electrical communication between a linear capacitor plate and the electrically functional substrate; and (5) etching the electrically functional substrate to form an inner inductor and an outer inductor. Alternatively, the second dielectric film may be formed on the thin dielectric, the second dielectric film having holes therein to facilitate subsequent formation of and electrical connection to at least one linear capacitor plate and one nonlinear capacitor plate, then the semiconducting component for the nonlinear capacitor plate may be formed in a corresponding hole in the second dielectric film.

The method of tuning generally includes the steps of: (1) forming a conductive structure configured to provide electrical communication between a capacitor plate of a surveillance and/or identification device and an electrically functional substrate; and (2) etching the electrically functional substrate to form an inductor and an electromagnetically active inner plug or ring with dimensions and/or a location sufficient to shift a resonant frequency of the inductor. Thus, the surveillance and/or identification device can be tuned by locating the inner inductor such that a resonant frequency of the outer inductor increases by a desired amount, relative to locating the inner inductor in the geometric center of the outer inductor. Alternatively, tuning may include placing a conductive plug or ring in an appropriate or predetermined location in an inductor or on the passivation layer at the completion of manufacture.

Even further aspects of the invention concern methods of using the present device. The invention, in its various aspects, will be explained in greater detail below with regard to exemplary embodiments.

Exemplary Multi-Coil MOS EAS and/or RF Tags/Devices

One aspect of the invention relates to a surveillance and/or identification device, generally as described herein. In a preferred embodiment, the nonlinear capacitor includes a semiconductor component on the dielectric film. Generally, the semiconductor component comprises a first Group IVA element (e.g., Si, Ge, or a combination thereof), a III-V compound semiconductor, a II-VI (or chalcogenide compound) semiconductor such as ZnO or ZnS, or an organic or polymeric semiconductor.

Referring now to FIG. 1A, a cross-sectional view of an exemplary dual coil embodiment of the present tag/device is shown and indicated by the general reference character 100. In this particular example, one linear and one nonlinear capacitor are included. The nonlinear capacitor includes capacitor plate 10*a*-1, dielectric film 20, semiconductor components 30 and 35, and capacitor plate 50-1. In the particular example of FIG. 1A, semiconductor component 30 may be an $n^-$ doped silicon film and semiconductor component 35 may be an $n^+$ doped silicon film. Successive silane coating/curing processes may be used as described below and in copending U.S. application Ser. No. 10/885,283, filed on Jul. 6, 2004 (the relevant portions of which are incorporated herein by reference), to form the $n^-$ doped silicon film 30 and an $n^+$ doped silicon film 35 thereon, or, alternatively to form an n-doped silicon film 30 and a p-doped silicon film 35 thereon or vice versa (each of which may comprise multiple layers of differing dopant concentrations, or which may have an intrinsic semiconductor layer between them) to form a conventional p-n, p-i-n or Schottky diode. Semiconductor components 30 and 35 can allow the EAS tag 100 to be operated in frequency division, frequency mixing, and/or frequency multiplication modes.

Figure 1B:
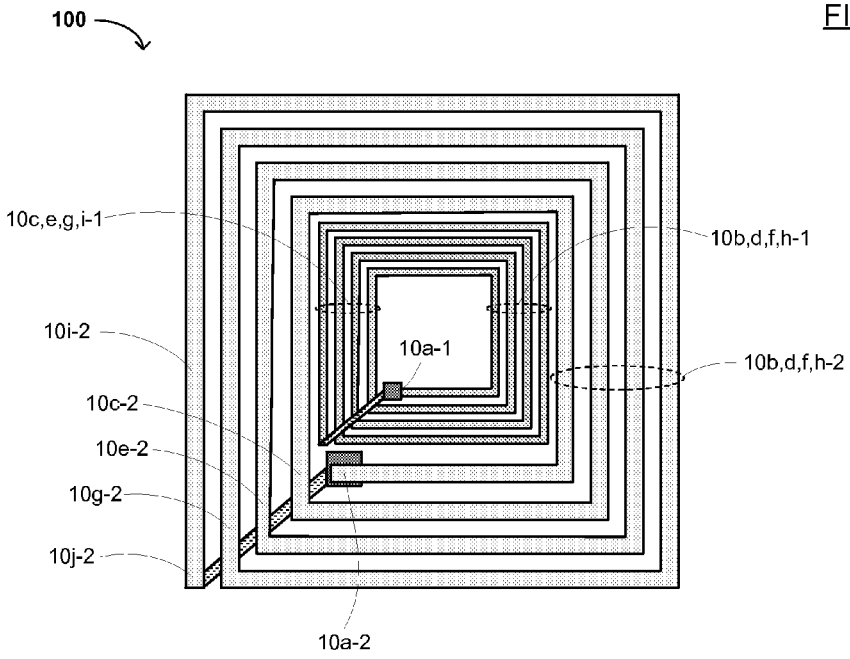
FIG. 1B shows a bottom or plan view of a concentric arrangement of two coils according to the embodiment of FIG. 1A.

The linear capacitor includes capacitor plate 10*a*-2, dielectric film 20, and capacitor plate 50-2. EAS tag 100 further includes interlayer dielectric (ILD) 40, first conductor 55-1, second conductor 55-2, first interconnect pad 58-1, second interconnect pad 58-2, and passivation 60. A key feature of the present EAS tag 100 is semiconductor component portion 30/35, which enables tag 100 to be operated in frequency division, frequency mixing, and/or frequency multiplication modes. In certain embodiments, semiconductor component 30/35 further enables use of EAS tag 100 at advantageous radio frequencies, such as 100-400 kHz, 13.56 MHz or 900-950 MHz, as will be explained in greater detail below. As is also shown in FIG. 1B (discussed in more detail below), the inner coil or inductor in this particular example can include four concentric turns from capacitor plate 10*a*-1: a first loop or ring (10*b*-1, 10*c*-1), a second loop or ring (10*d*-1, 10*e*-1), a third loop or ring (10*f*-1, 10*g*-1), and a fourth loop or ring (10*h*-1, 10*i*/10*j*-1), but any suitable number of loops or rings may be employed, depending on application requirements and/or design choices/preferences. Similarly, the outer coil or inductor in this particular example can include four concentric turns from capacitor plate 10*a*-2: a first loop or ring (10*b*-2, 10*c*-2), a second loop or ring (10*d*-2, 10*e*-2), a third loop or ring (10*f*-2, 10*g*-2), and a fourth loop or ring (10*h*-2, 10*i*-2), but any suitable number of loops or rings may be employed, depending on application requirements and/or design choices/preferences.

Interconnect pad 10*j*-1 for the inner inductor can be used to electrically connect the inner inductor to the nonlinear capacitor via first interconnect pad 58-1, conductor or electrode strap 55-1 and capacitor plate 50-1. Similarly, interconnect pad 10*j*-2 for the outer inductor can be used to electrically connect the outer inductor to the linear capacitor via second interconnect pad 58-2, conductor or electrode strap 55-2 and capacitor plate 50-2.

Generally, capacitor plate 10*a*-1 (and/or 10*a*-2) and inductor 10*b*-1 through 10*j*-1 (and/or 10*b*-2 through 10*j*-2) are coplanar and comprise an electrically conductive material, preferably a first metal. As will be explained in greater detail with regard to the present method of manufacturing below, capacitor plate 10*a*-1 (and/or 10*a*-2) and inductor 10*b*-1 through 10*j*-1 (and/or 10*b*-2 through 10*j*-2) may be advantageously formed from a single sheet or foil of a metal or alloy. However, in alternative embodiments, the metal/alloy for capacitor plate 10*a*-1 (and/or 10*a*-2) and inductor 10*b*-*i* through 10*j*-1 (and/or 10*b*-2 through 10*j*-2) may be conventionally deposited or printed onto the backside of dielectric film 20. The metal may comprise aluminum, titanium, copper, silver, chromium, molybdenum, tungsten, nickel, gold, palladium, platinum, zinc, iron, stainless steel or other conventional alloy thereof. Other conductive materials may include conductive polymers, such as doped polythiophenes, polyimides, polyacetylenes, polycyclobutadienes and polycyclooctatetraenes; conductive inorganic compound films, such as titanium nitride, tantalum nitride, indium tin oxide, etc.; and doped semiconductors, such as doped silicon, doped germanium, doped silicon-germanium, doped gallium arsenide, doped (including auto-doped) zinc oxide, zinc sulfide, etc. Also, the metal/alloy for capacitor plate 10*a*-1 (and/or 10*a*-2) and inductor 10*b*-1 through 10*j*-1 (and/or 10*b*-2 through 10*j*-2) may comprise a multi-layer structure, such as aluminum, tantalum or zirconium deposited (e.g., by sputtering or CVD) onto a thin copper sheet or foil, or copper deposited (e.g., by electroplating) onto a thin aluminum sheet or foil. The metal for the capacitor plate 10*a*-1 (and/or 10*a*-2) may be chosen at least in part based on its ability to be anodized into an effective dielectric. This includes Al, Ta and other metals. In preferred embodiments, the first metal comprises or consists essentially of aluminum.

In the present surveillance and/or identification device 100, the inductor 10*b*-1 through 10*j*-1 (and/or 10*b*-2 through 10*j*-2), capacitor plate 10*a*-1 (and/or 10*a*-2) may have a nominal thickness of from 5 to 200 μm (preferably from 20 to 100 μm) and/or a resistivity of 0.1-10 μohm-cm (preferably from 0.5 to 5 μohm-cm, and in one embodiment, about 3 μohm-cm). While the capacitor plate 10*a*-1 of FIG. 1A may be located substantially in (or near) the center of the device, it may be located in any area of the device, in accordance with design choices and/or preferences. Also, capacitor plate 10*a*-1 (and/or 10*a*-2) may have any desired shape, such as round, square, rectangular, triangular, hexagonal, octagonal, etc., with nearly any dimensions that allow it to fit in and/or on the EAS tag 100. Preferably, capacitor plate 10*a*-1 and/or 10*a*-2 have dimensions of (i) width, length and thickness, or (ii) radius and thickness, in which the thickness is substantially smaller than the other dimension(s). For example, capacitor plates 10*a*-1 and 10*a*-2 may independently have a radius of from 25 to 10,000 μm (preferably 50 to 5,000 μm, 100 to 2,500 μm, or any range of values therein), or a width and/or length of 50 to 20,000 μm, 100 to 10,000 μm, 250 to 5,000 μm, or any range of values therein. In one embodiment, capacitor plate 10*a*-2 has major surface dimensions at least 10% smaller than those of capacitor plate 10*a*-1. In further embodiments, the major surface area of capacitor plate 10*a*-2 is at least 20% or 50% smaller than that of capacitor plate 10*a*-1. In one implementation, the major surface dimensions of capacitor plates 10*a*-1 and 10*a*-2 are such that the resonance of the outer inductor is about 2× that of the inner inductor.

Figure 11A:
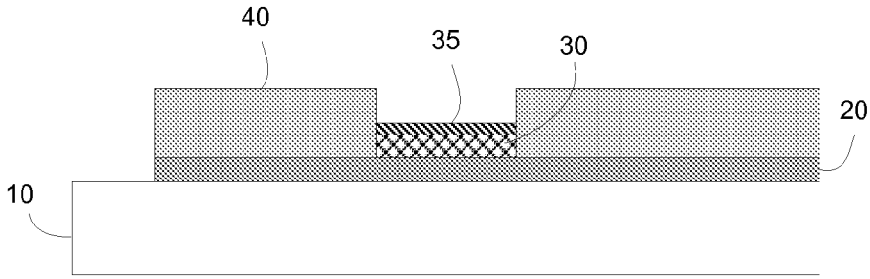
Figure 11B:
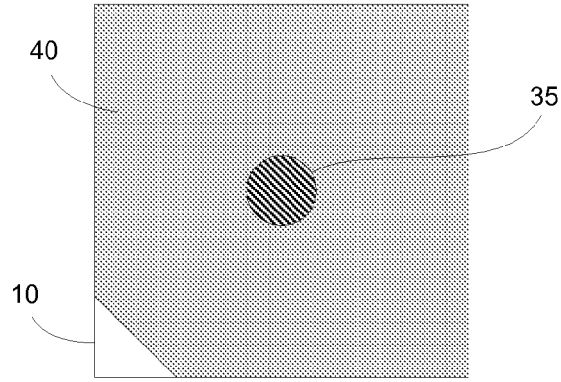

Referring now to FIG. 11B, a bottom or plan view of a concentric arrangement of two coils according to an embodiment of the present invention is shown. The inner coil or inductor in this particular example can include four concentric "turns" from capacitor plate 10*a*-1: a first loop or ring (10*b*-1, 10*c*-1), a second loop or ring (10*d*-1, 10*e*-1), a third loop or ring (10*f*-1, 10*g*-1), and a fourth loop or ring (10*h*-1, 10*i*-1), but any suitable number of loops or rings may be employed, depending on application requirements and/or design choices/preferences. Similarly, the outer coil or inductor in this particular example can include four concentric turns from capacitor plate 10*a*-2: a first loop or ring (10*b*-2, 10*c*-2), a second loop or ring (10*d*-2, 10*e*-2), a third loop or ring (10*f*-2, 10*g*-2), and a fourth loop or ring (10*h*-2, 10*i*-2), but any suitable number of loops or rings may be employed, depending on application requirements and/or design choices/preferences. As will be discussed below with reference to FIGS. 9A and 9B, interconnect pad 10*j*-2 can be used to electrically connect the outer coil or inductor to capacitor plate 10*a*-2. A similar connection to another capacitor can be made for the inner coil or inductor, where one plate of that capacitor is 10*a*-1.

While the inductor patterns shown in FIG. 1B are essentially symmetric and evenly spaced, they may take any form and/or shape conventionally used for such inductors. Preferably, the inductor pattern has a coil, or concentric spiral loop, form. For ease of manufacturing and/or device area efficiency, the coil loops generally have a square or rectangular shape, but they may also have a rectangular, octagonal, circular, rounded or oval shape, some other polygonal shape, or any combination thereof, and/or they may have one or more truncated corners, according to application and/or design choices and/or preferences, as long as each successive loop is substantially entirely positioned between the preceding loop and the outermost periphery of the tag/device. Important aspects of the design of FIG. 1B include substantial coplanarity and a concentric arrangement of the two coils, which simplifies the processing and enables production of a thin, flexible tag.

Referring back to FIG. 1A, the concentric loops or rings of the inductor coil 10*b*-1 through 10*h*-1 (and/or 10*b*-2 through 10*h*-2) may have any suitable width and pitch (i.e., inter-ring spacing), and the width and/or pitch may vary from loop to loop or ring to ring. However, in certain embodiments, the wire in each loop (or in each side of each loop or ring) may independently have a width of from 2 to 1000 μm (preferably from 5 to 500 μm, 10 to 200 μm, or any range of values therein) and length of 100 to 50,000 μm, 250 to 25,000 μm, 500 to 20,000 μm, or any range of values therein (as long as the length of the inductor wire does not exceed the dimensions of the EAS device). Alternatively, the radius of each wire loop or ring in the inductor may be from 250 to 25,000 μm (preferably 500 to 20,000 μm). Similarly, the pitch between wires in adjacent concentric loops or rings of the inductor may be from 2 to 1000 μm, 3 to 500 μm, 5 to 250 μm, 10 to 200 μm, or any range of values therein. Furthermore, the width-to-pitch ratio may be from a lower limit of about 1:10, 1:5, 1:3, 1:2 or 1:1, up to an upper limit of about 1:2, 1:1, 2:1, 4:1 or 6:1, or any range of endpoints therein. In one embodiment, inductor coil loops or rings 10*b*-2 through 10*h*-2 have a width at least 10% greater than those of inductor coil loops or rings 10*b*-1 through 10*h*-1. In further embodiments, the width of inductor coil loops or rings 10*b*-2 through 10*h*-2 are at least 20% or 50% greater than those of inductor coil loops or rings 10*b*-1 through 10*h*-1.

Similarly, interconnect pad 10*j*-1 and/or 10*j*-2 (which is generally configured to provide electrical communication and/or physical contact with electrode strap or conductor 55-1 and/or 55-2, respectively) may have any desired shape, such a round, square, rectangular, triangular, etc., with nearly any dimensions that allow it to fit in and/or on the EAS tag 100 and provide electrical communication and/or physical contact with conductor 55-1 and/or 55-2. Preferably, interconnect pad 10*j*-1 and/or 10*j*-2 has dimensions of (i) width, length and thickness, or (ii) radius and thickness, in which the thickness is substantially smaller than the other dimension(s). For example, interconnect pad 10*j*-1 and/or 10*j*-2 may have a radius of from 25 to 2000 μm (preferably 50 to 1000 μm, 100 to 500 μm, or any range of values therein), or a width and/or length of 50 to 5000 μm, 100 to 2000 μm, 200 to 1000 μm, or any range of values therein. The relative dimensions of interconnect pads 10*j*-1 and 10*j*-2 may be the same as those of capacitor plates 10*a*-1 and 10*a*-2.

Use of a substrate formed from a thin metal sheet or foil provides a number of advantages in the present invention. For example, one of the electrodes of the device (preferably, a gate and/or capacitor plate 10*a*-1 and/or 10*a*-2) can be formed from the metal sheet or foil. A thin metal sheet or foil (which may have a major surface composed primarily of Al or Ta) provides a convenient source for dielectric film 20 by a relatively simple and straightforward process technology, such as anodization. A metal sheet or foil also provides a conductive element that can be formed into an inductor coil or antenna using conventional metal film process technology. Also, metal sheets and/or foils have suitable high-temperature processing properties for subsequent processing steps (such as those described below with regard to the present method of manufacturing), unlike many inexpensive organic polymer substrates.

Referring back to FIG. 1A, the dielectric film 20 preferably is designed and made such that application of a deactivating radio frequency electromagnetic field induces a voltage differential in the linear and/or MOS capacitor(s) across dielectric film 20 that will deactivate the tag/device (e.g., a voltage differential of about 4 to about 50 V, preferably about 5 to less than 30 V, more preferably about 10 to 20 V, or any desired range of endpoints therein) through breakdown of that film to shorted state or changed capacitance such that the tag circuit no longer resonates at the desired frequency. Thus, in certain embodiments, the dielectric film has (i) a thickness of from 50 to 400 Å and/or (ii) a breakdown voltage of from about 10 to about 20V. The dielectric film 20 may comprise any electrically insulative dielectric material, such as oxide and/or nitride ceramics or glasses (e.g., silicon dioxide, silicon nitride, silicon oxynitride, aluminum oxide, tantalum oxide, zirconium oxide, etc.), polymers such as polysiloxanes, parylene, polyethylene, polypropylene, undoped polyimides, polycarbonates, polyamides, polyethers, copolymers thereof, fluorinated derivatives thereof, etc. However, for reasons that will become apparent in the discussion of the manufacturing method discussed below, dielectric film 20 preferably comprises or consists essentially of aluminum oxide and/or a corresponding oxide of the metal used for capacitor plates 10*a*-1 and/or 10*a*-2 and/or inductors 10*b*-1 through 10*j*-1 and/or 10*b*-2 through 10*j*-2.

As mentioned above, the semiconductor component 30 generally comprises a semiconductor, preferably a Group IVA element. Preferably, the Group IVA element comprises silicon. Alternatively, the Group IVA element may consist essentially of silicon or silicon-germanium. Alternatively, the semiconductor component 30 may comprise or consist essentially of a III-V or II-VI compound semiconductor such as indium phosphide, zinc oxide, or zinc sulfide. In any case, whether the semiconductor component 30 comprises or consists essentially of an elemental or compound semiconductor, the semiconductor component 30 may further comprise an electrical dopant. In the case of silicon or silicon-germanium, the dopant may be selected from the group consisting of boron, phosphorous and arsenic, typically in a conventional concentration (e.g., light or heavy, and/or from $10^{13}$ to $10^{15}$, $10^{15}$ to $10^{17}$, $10^{16}$ to $10^{18}$, $10^{17}$ to $10^{19}$, $10^{19}$ to $10^{21}$ atoms/cm$^3$ or any range of values therein). For example, it may be advantageous to dope the semiconductor component 30 in order to improve the frequency response. A simple RC analysis suggests that conductivities of ~$2\times10^{-2}$ S/cm or higher may be commercially useful for high Q 13.56 MHz operation. It may also be advantageous to heavily dope the near or upper surface region of the semiconductor component, or provide a second heavily-doped (e.g., having a dopant concentration within the last two ranges described above) semiconductor component 35 adjacent to the first semiconductor component 30, to assist in low resistance contact formation and reduce the parasitic series resistance of the device.

Although the semiconductor component 30 may take nearly any form with nearly any dimensions, preferably it has a layered form, in that it may have dimensions of (i) width, length and thickness, or (ii) radius and thickness, in either case the thickness being substantially smaller than the other dimension(s). For example, the semiconductor component 30 may have a thickness of from 30 nm to 500 nm, preferably from 50 nm to 200 nm, but a radius of from 5 to 10,000 μm, (preferably 10 to 5,000 μm, 25 to 2,500 μm, or any range of values therein), or a width and/or length of 10 to 20,000 μm, 25 to 10,000 μm, 50 to 5,000 μm, or any range of values therein. Semiconductor component 30 may also comprise a multilayer structure, such as a metal silicide layer on a silicon-containing layer, successive $n^+/n^-$ doped silicon films, or alternating n-doped and p-doped silicon films (each of which may comprise multiple layers of differing dopant concentrations, or which may have an intrinsic semiconductor layer between them) to form a conventional p-n, p-i-n or Schottky diode (in which case the semiconductor component 30 may have a second conductor 35 in electrical communication with a different layer of semiconductor component 30 than conductor 55-1), etc. In the case of a diode structure, the MOS dielectric may be omitted or locally removed to facilitate electrical contact between the device electrodes and the internal semiconducting components. This could be facilitated with the use of one or more printed (or otherwise deposited) masking materials prior to the anodization, or through a local removal process (e.g., etching) after the dielectric formation. In the case where the semiconductor is in direct contact with the inductor/capacitor electrode metal, it may be advantageous to provide a metallic, intermetallic or other type of barrier layer to prevent detrimental interdiffusion or "spiking" through the device, such as is known to be the case for Al and Si at elevated temperatures.

Electrode strap or conductor 55-1 generally provides electrical communication between the semiconductor component 30/35 and the inductor 10*b*-1 through 10*i/j*-1, but in most of the present EAS and/or RFID tags, conductor 55-1 generally further comprises a second capacitor plate 50-1 (i) capacitively coupled (or complementary) to the first capacitor plate 10*a*-1 and (ii) in substantial physical contact (e.g., having a major surface in contact) with the semiconductor component 30/35. Similarly, strap or conductor 55-2 generally provides electrical communication between the inductor 10*b*-2 through 10*i/j*-2 and capacitor plate 50-2 (which is capacitively coupled to the first capacitor plate 10*a*-2). While (i) conductors 55-1 and 55-2 and (ii) capacitor plates 50-1 and 50-2 are preferably formed at the same time from the same material(s), they may be formed separately and/or from different materials. Also, while conductors 55-1 and 55-2 may comprise any electrically conductive material, generally conductors 55-1 and/or 55-2 comprise a second metal, which may be selected from the same materials and/or metals described above for the nonlinear capacitor plates 10*a*-1 and 10*a*-2 and/or inductors 10*b*-I through 10*i/j*-1 and 10*b*-2 through 10*i/j*-2. In preferred embodiments, the second metal comprises or consists essentially of silver, gold, copper or aluminum (or a conductive alloy thereof).

Conductors 55-1 and/or 55-2 (and, by association, capacitor plates 50-1 and/or 50-2 and interconnect pads 58-1 and/or 58-2) may take nearly any form with nearly any dimensions, but preferably, it has a layered form, in that it may have dimensions of width, length and thickness, in which the thickness is smaller than the other dimension(s). For example, conductors 55-1 and/or 55-2 (and, when unitary, second capacitor plates 50-1 and/or 50-2 and interconnect pads 58-1 and/or 58-2) may have a thickness of from 30 nm to 5000 nm, preferably from 50 nm to 2000 nm, more preferably from 80 nm to 500 nm. Capacitor plates 50-1 and/or 50-2 may have radius, width and/or length dimensions that substantially match (or that are slightly greater than or slightly less than) those of capacitor plates 10*a*-1 and/or 10*a*-2, respectively (e.g., a radius of from 20 or 30 to 10,000 μm, 40 or 60 to 5,000 μm, 80 or 125 to 2,500 μm, or any range of values therein; or a width and/or length of 40 or 60 to 20,000 μm, 80 or 125 to 10,000 μm, 150 or 250 to 5,000 μm, or any range of values therein).

Furthermore, in addition to respectively connected capacitor plates 50-1 and/or 50-2, conductors 55-1 and/or 55-2 may comprise (i) a pad portion 58-1 and/or 58-2 for respective electrical communication with the inner inductor (10*b*-1 through 10*i/j*-1) or the outer inductor (10*b*-2 through 10*i/j*-2) and (ii) one or more wire portions electrically connecting capacitor plate 50-1 and/or 50-2 and pad portion 58-1 and/or 58-2. As for other conductive structures in the present device, the wire portion(s) may have a width of from 2 to 1000 μm (preferably from 5 to 500 μm, 10 to 200 μm, or any range of values therein) and length of 100 to 25,000 μm, 250 to 20,000 μm, 500 to about 15,000 μm, or any range of values therein (as long as the length of the inductor wire does not exceed the dimensions of the EAS device 100, or half of such dimensions if capacitor plate 50-1 and/or 50-2 is in the center of device 100, as the case may be). Pad portion 58-1 and/or 58-2 generally has the same thickness as conductor 55-1 and/or 55-2, and may have any suitable shape (e.g., square, rectangular, round, etc.). In various embodiments, pad portion 58-1 and/or 58-2 has a width and/or length of from 50 to 2000 μm, 100 to about 1500 μm, 200 to 1250 μm, or any range of values therein; or a radius of from 25 to 1000 μm, 50 to 750 μm, 100 to 500 μm, or any range of values therein. In general, it may be advantageous to minimize the parasitic capacitance resulting from overlap of the capacitor pad not directly over the semiconductor component and wire connection by minimizing length and width of these features.

In the present EAS device, the combination of the semiconductor component 30/35 and second capacitor plate 50-1 effectively forms a nonlinear capacitor with the corresponding portion of the dielectric film 20 and the complementary first capacitor plate 10*a*-1. Below a predetermined threshold voltage (or a predetermined voltage differential across dielectric film 20 and semiconductor component 30/35), second capacitor plate 50-1 functions as the capacitor plate complementary to first capacitor plate 10*a*-1, and dielectric film 20 and semiconductor component 30/35 together function as the capacitor dielectric between first and second capacitor plates 10*a*-1 and 50-1. However, above the predetermined threshold voltage (or predetermined voltage differential), charge carriers (e.g., electrons) may be collected and/or stored in semiconductor component 30/35, generally near the interface of the semiconductor component 30/35 and dielectric film 20, thereby changing the capacitive properties of the circuit. Thus, the capacitance and/or other capacitive properties of the circuit typically vary in dependence on the voltage across the capacitor, effectively making a nonlinear capacitor from the combination of second capacitor plate 50-1, semiconductor component 30/35, dielectric film 20 and first capacitor plate 10*a*-1. In various embodiments, the predetermined threshold voltage is from −10V to 10V, from about −5V to about 5V, from about −1V to about 1V, or any range of voltages therein. Alternatively, the highest slope of the CV curve of such a capacitor may occur at a voltage of from −5V to 5V, −1V to 1V, any range of voltages therein, or ideally, about 0V. Electrical dopant concentrations in the semiconductor component may also be used to control the shape and slope(s) of the CV curve. The transition with changing bias across the device from the high capacitance state of the metal-oxide-semiconductor (MOS) capacitor device when charge is being stored at the oxide-semiconductor interface (such as in the accumulation mode of MOS device operation), to the mode where incremental charge is being stored at location(s) extending through the semiconductor (the so-called depletion mode), and therefore with a decreasing capacitance, can be a direct function of the dopant profile (see, e.g., Sze, S. M., "Physics of Semiconductor Devices," $2^{nd}$ ed. (1981), John Wiley & Sons, New York, N.Y.; pp. 74-81).

The present EAS device may further comprise an interlayer dielectric 40 between the dielectric film 20 and the conductor 55-1 and/or 55-2. The interlayer dielectric 40 generally includes (1) a first via or opening at a location overlapping with at least part of the semiconductor component 30/35 and (2) a second via or opening at a location overlapping with at least part of the dielectric film 20 overlying capacitor plate 10*a*-2. FIG. 1A shows one embodiment in which the semiconductor component 30/35 is entirely within the via 45 (see also, e.g., FIGS. 10A-11B). In an alternative embodiment (see, e.g., FIGS. 6A-9A), the semiconductor component 30/35 has a peripheral region (or periphery), and the interlayer dielectric 40 is also between the periphery and the conductor 55, as shown. Referring back to FIG. 1A, the via or opening preferably has a radius, or alternatively, width and/or length dimensions, substantially the same as capacitor plate 50-1. However, alternatively (e.g., in the embodiment of FIGS. 2A-9B), semiconductor component 30/35 may have radius, width and/or length dimensions greater than those of the via.

The interlayer dielectric 40 may comprise any electrically insulative material providing the desired dielectric properties, similar to and/or including those given above for dielectric film 20. However, thickness tolerances of interlayer dielectric 40 are not as small in absolute terms as those of dielectric film 20, so polymers such as polysiloxanes, parylene, fluorinated organic polymers, etc., may be more easily used in interlayer dielectric 40. However, interlayer dielectric 40 may comprise an oxide and/or nitride of a second Group IVA element, which may further contain conventional boron and/or phosphorous oxide modifiers in conventional amounts. To minimize parasitic capacitances with inductor 10*b*-1 through 10*i*/*j*-1 and/or 10*b*-2 through 10*i*/*j*-2, interlayer dielectric 40 may have a thickness of at least 1 μm, and preferably from 2 to 25 μm, 5 to 10 μm, or any range of values therein.

The embodiment shown in FIGS. 2A-9B has certain advantages over other approaches. For example, in the case of a printed semiconductor component, potentially detrimental edge morphology, such as edge spikes and/or relatively appreciable thickness variations near the feature edge, may be present. By positioning the active area of the MOS nonlinear capacitor away from these potentially detrimental edge regions (e.g., when the ILD via hole 45 [see also, e.g., FIG. 10A] is smaller than the printed semiconductor feature dimensions), the impact of edge morphology can be reduced. However, as will be discussed below with regard to FIGS. 11A-B, the alternative embodiment produced from the structure of FIGS. 11A-B also has certain advantages as well. For example, nonlinear capacitor variations may be minimized in the alternative embodiment of FIGS. 11A-B, thereby improving suitability for applications requiring minimal deviations from an ideal and/or predetermined resonance frequency.

The present device may further comprise a passivation layer 60 over the conductor 55-1 and/or 55-2 and interlayer dielectric 40. Passivation layer 60 is conventional, and may comprise an organic polymer (such as polyethylene, polypropylene, a polyimide, copolymers thereof, etc.) or an inorganic dielectric (such as aluminum oxide, silicon dioxide [which may be conventionally doped and/or which may comprise a spin-on-glass], silicon nitride, silicon oxynitride, or a combination thereof as a mixture or a multilayer structure). Passivation layer 60 generally has the same width and length dimensions as the EAS device, and it may also have any thickness suitable for EAS, RF and/or RFID tags or devices. In various embodiments, passivation layer 60 has a thickness of from 3 to 100 μm, from 5 to 50 μm, 10 to 25 μm, or any range of values therein.

The present device may also further comprise a support and/or backing layer (not shown) on a surface of the inductors 10*b*-1 through 10*i*/*j*-1 and 10*b*-2 through 10*i*/*j*-2 opposite the dielectric film 20. The support and/or backing layer are conventional, and are well known in the EAS and RFID arts (see, e.g., U.S. Pat. Appl. Publication No. 2002/0163434 and U.S. Pat. Nos. 5,841,350, 5,608,379 and 4,063,229, the relevant portions of each of which are incorporated herein by reference). Generally, such support and/or backing layers provide (1) an adhesive surface for subsequent attachment or placement onto an article to be tracked or monitored, and/or (2) some mechanical support for the EAS device itself. For example, the present EAS tag may be affixed to the back of a price or article identification label, and an adhesive coated or placed on the opposite surface of the EAS tag (optionally covered by a conventional release sheet until the tag is ready for use), to form a price or article identification label suitable for use in a conventional EAS system.

Exemplary MOS EAS and/or RF Tags/Devices Having Three or More Coils

Figure 1C:
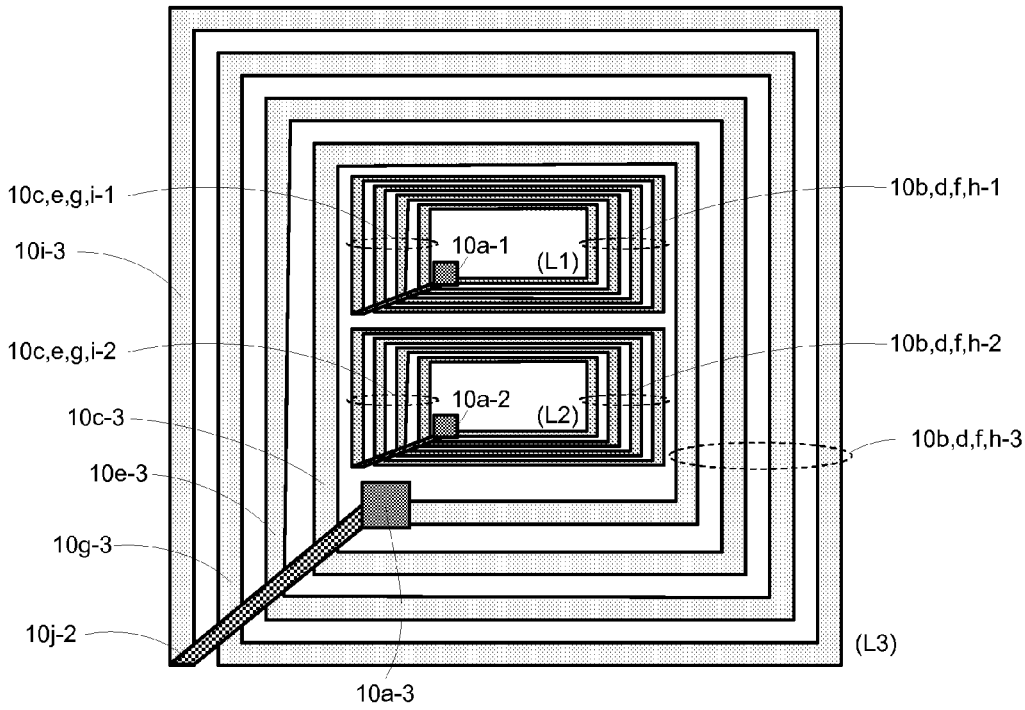
FIG. 1C shows a bottom or plan view of a multiple coil tag design with two active inner coils and one outside passive coil according to an embodiment of the present invention.

Referring now to FIG. 1C, a bottom or plan view of a multiple coil tag design with two active inner coils (L1 and L2) and one outside passive coil (L3) according to an embodiment of the present invention is shown. As for the example of FIG. 1B, each coil or inductor in this particular example can include four concentric turns from a corresponding capacitor plate. Of course, any suitable number of loops or rings may be employed for L1, L2, or L3, depending on particular application requirements and/or design choices/preferences.

In one aspect of the embodiment of FIG. 1C, the EAS/RF tag can have two memory bits or "write once" memory elements. Alternatively, more than two bits of such memory may be included according to embodiments of the present invention. In the embodiment of FIG. 1C, the first inner active RLC circuit including inductor L1 may be tuned to resonate at frequency F1, while the second inner active RLC circuit including inductor L2 may be tuned to resonate at frequency F2, with such a relation as shown in the following formula (1):

$$(0.9*F1)<F2<(1.1*F1) \quad (1)$$

The outer passive RLC circuit including inductor L3 may then be made to resonate at F1+F2. In this way, both active circuits can couple to the passive circuit, and thus, the F/2 turn-on field threshold of both active circuits can be lowered.

Figure 1D:
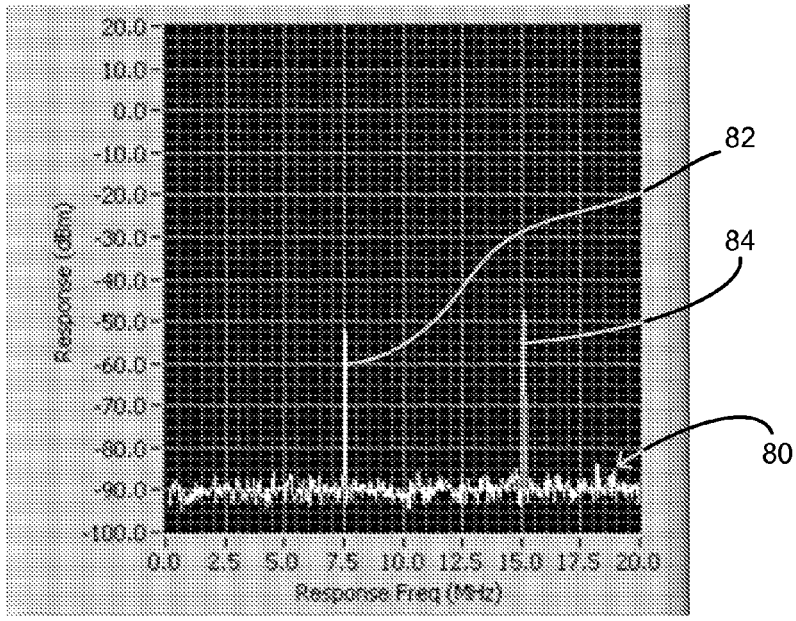
FIG. 1D shows waveform activity for deactivation of a first inner circuit in an implementation according to FIG. 1C.

Referring now to FIG. 1D, waveform activity (80) for deactivation of a first inner circuit in an implementation according to FIG. 1C is shown. A high strength RF field tuned to 2*F1 may be applied to the device to deactivate the first inner active circuit RLC circuit. In this particular example, F1=7.5 MHz, as indicated by response 82. At 2*F1 or 15 MHz, as indicated by response 84, the first inner RLC circuit can be deactivated. As discussed above, a deactivation may be effectuated by non-volatile shifting of the thresholds (i.e., position of the CV curve features versus voltage) or capacitance of the device in response to an applied electromagnetic field having sufficient strength and an effective oscillating frequency to induce a current, voltage and/or resonance in the device. Typically, the device is deactivated when the presence of the object or article in the detection zone is not to be detected or otherwise known.

Figure 1E:
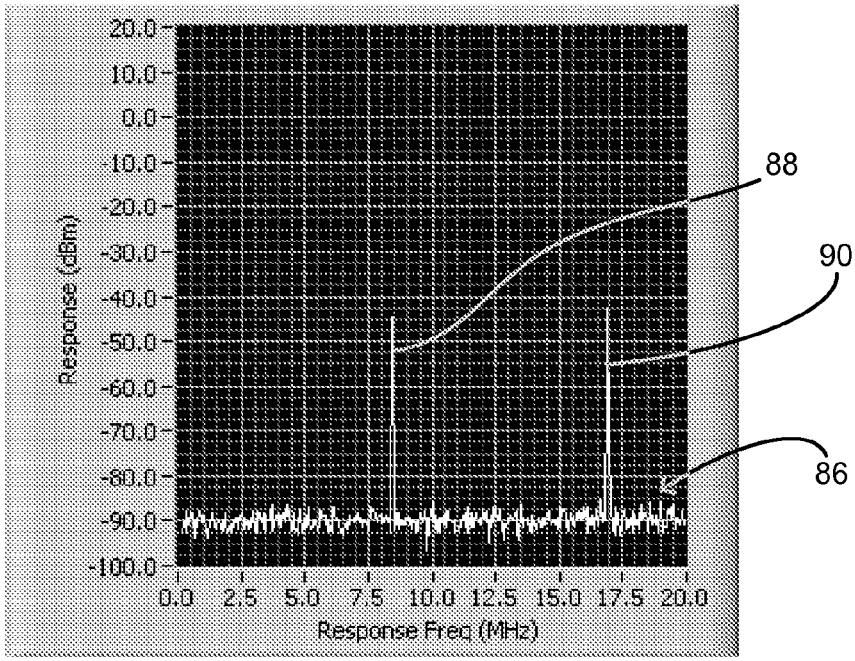
FIG. 1E shows waveform activity for deactivation of a second inner circuit in an implementation according to FIG. 1C.

Referring now to FIG. 1E, waveform activity (86) for deactivation of a second inner circuit in an implementation according to FIG. 1C is shown. A high strength RF field tuned to 2*F2 may be applied to the device to deactivate the second inner active circuit RLC circuit. In this particular example, F2=8.5 MHz, as indicated by response 88. At 2*F2 or 17 MHz, as indicated by response 90, the second inner RLC circuit can be deactivated. As discussed above, a deactivation may be effectuated by non-volatile shifting of the thresholds or capacitance of the device (i.e., shorting the two capacitor plates together) in response to an applied electromagnetic field having sufficient strength and an effective oscillating frequency to induce a current, voltage and/or resonance in the device. Typically, the device is deactivated when the presence of the object or article in the detection zone is not to be detected or otherwise known.

Figure 1F:
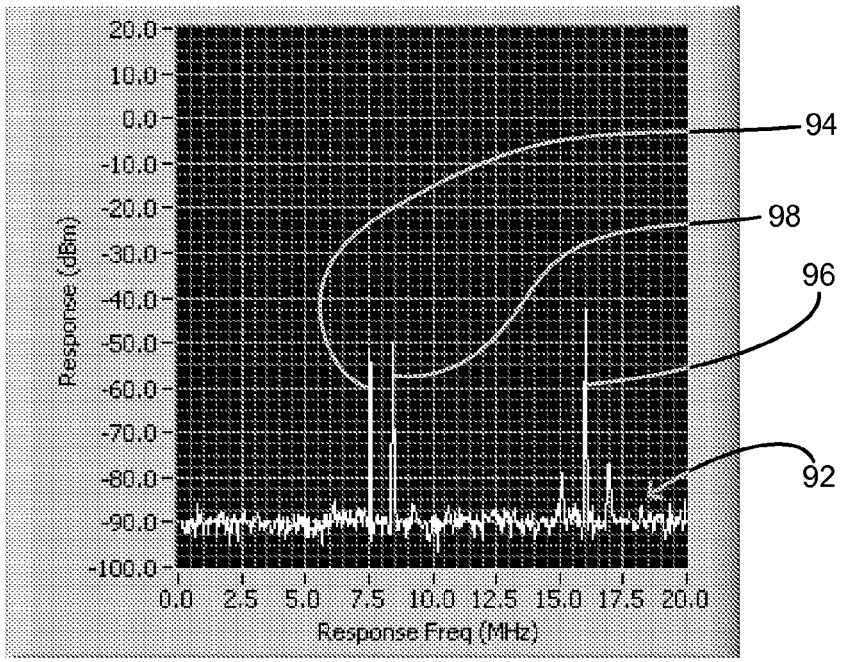
FIG. 1F shows waveform activity for reading the device in an implementation according to FIG. 1C.

Referring now to FIG. 1F, waveform activity (92) for reading the device in an implementation according to FIG. 1C is shown. The device may be read by sweeping a low strength RF field over the range spanning F1 (see response 94) to F2 (see response 98), or by applying a fixed frequency medium strength RF field tuned to F1+F2 (see response 96).

Design Considerations for Multi-Coil EAS Tags/Devices

One design consideration in implementing an EAS tag in accordance with embodiments of the present invention is frequency of operation. There is a range of frequencies of interest for RF EAS and RFID tags, including 2.55 GHz, 915 MHz, 13.56 MHz, 1-10 MHz (swept), and below 400 kHz. In many retail applications, frequencies around 13.56 MHz and below are advantageous as compared to higher frequencies as they are less line-of-sight and/or orientation-dependent, but more compatible with liquids and organic matter.

An advantage of the dual (or multiple) coil design according to embodiments is that flux enhancement and frequency division threshold lowering can also be translated into a higher bandwidth of operation for creating F/2 signal(s) at a given RF field or system read range. This is of particular advantage in printed devices, where the manufacturing tolerances may be more difficult to control than in conventionally fabricated components, leading to more variation in the tag's resonant frequencies. It is an object of embodiments of the present invention to provide a tag configured to operate at 13.56 MHz with as large a bandwidth as possible for frequency division at fields as low as about 50-150 mA/m.

Other design considerations in implementing an EAS tag in accordance with embodiments of the present invention include component geometry as well as overall geometry. The total tag should be relatively small, thin and flexible for many retail applications where large tag size, visual presence or physical obtrusiveness is undesirable. Commercially available RF EAS and RFID tags (which may operate in the RF range from ~8 MHz to 14 MHz) are typically square or rectangular, no more than a few hundred microns thick, flexible, and can vary from 4 to 5 cm length per side. Therefore, an ideal design for a complete RF EAS tag would be approximately square, ≦4 cm per side, and planar (e.g., having no more than a conventional thickness).

Another design consideration in implementing an EAS tag in accordance with embodiments of the present invention involves coupling characteristics between the two or more coils. There is an optimal range for the amount of coupling between two coils. For example, very strong coupling, which results when the two coils are almost overlapping, actually degrades the dual coil enhancement effect. Further, in more extreme cases, the overlap may result in the loss of two independent resonances. On the other hand, very weak coupling between the coils can result in frequency division performance degradation, as the flux enhanced by the linear LC coil is not effectively coupled into the nonlinear LC coil. Therefore, it is a further object of embodiments of the present invention to provide an optimal intermediate coupling between the two coils, in a substantially concentric and/or coplanar layout, which can maximize the frequency division efficiency.

It is also generally advantageous to have inductor coils with an enclosed area as large as possible and a large number of turns with which to maximize the EMF generated by the inductor in a given field. However, series resistance losses of the inductor coil should be minimized, as this has a detrimental impact on the Q of the inductor, and ultimately, on the frequency division threshold. It is a further object of embodiments of the present invention that an appropriate number of turns, coil dimensions, line widths and foil thickness can be selected so as to allow for high Q and low threshold operation using conductor feature sizes that can be reasonably achieved using flexible Al foils and conventional and/or low cost patterning processes, such as etching, die cutting, printing and/or stamping. A typical Al foil thickness appropriate for this application would be from 50-100 μm, and an acceptable space for a pattern would be approximately ≧250 μm.

Another design consideration in implementing an EAS tag in accordance with embodiments of the present invention involves the resonant frequencies. As discussed above, two inductive coils in close proximity have shifted resonances as compared to their separated individual resonances. For two closely-coupled coils in a frequency division tag, the coil tuned to the higher broadcast or carrier frequency tends to shift to higher frequencies and the coil tuned to the lower sensing or reading frequency tends to shift to lower frequencies. Accordingly, the coil layout as well as total effective L and C values should be optimized so that the final resonances are close to the carrier (broadcast) and desired subharmonic frequencies (sensing) in the concentric layout. The following Table 1 shows exemplary dual coil design specifications for an implementation in accordance with embodiments of the present invention. At fields of 50 mA/m, measured on a discrete prototype, using a broadcast frequency of 13.56 MHz, such an implementation produced a frequency division bandwidth in which the linear circuit frequency error of 1300 kHz and a nonlinear circuit frequency error of [linear shift−(2× nonlinear)]=700 kHz are tolerable.

TABLE 1

Exemplary dual-coil design specifications.

| Linear Coil Parameter | Specification | Optimum |
|---|---|---|
| Outer diameter Linear Coil | 3.5-4.5 cm | 4.0 cm |
| Turns for Linear Coil | 1-5 | 3 |
| Line width for Linear Coil | 0.75-2.0 mm | 1 mm |
| Inter-Line spacing for Linear Coil | 0.1-0.5 mm | 0.25 mm |
| Inner diameter for Linear Coil | 2.5-3.5 cm | 3.5 cm |
| Inductance for Linear Coil | 0.3-10 uH | 2 Uh |
| Capacitor for Linear Coil | 40-200 pF | 100 Pf |
| Q/dissipation for Linear Circuit | 50-200 | 100 |
| **Nonlinear Coil Parameter** | **Specification** | **Optimum** |
| Outer diameter Nonlinear Coil | 2.5-3.5 cm | 3.0 cm |
| Turns for Nonlinear Coil | 4-10 | 9 |
| Line width for Nonlinear Coil | 0.75-2.0 mm | 1 mm |
| Inter-Line spacing for Nonlinear Coil | 0.1-0.5 mm | 0.25 |

TABLE 1-continued

| Exemplary dual-coil design specifications. | | |
|---|---|---|
| Inner diameter for Nonlinear Coil | 0.5-2.5 cm | 2.0 cm |
| Inductance for Nonlinear coil | 1.0-4.0 uH | 2.3 Uh |
| Capacitor for Nonlinear Coil | 150-500 pF | 240 Pf |
| Q/dissipation for Nonlinear Circuit | 20-200 | 100 |
| MOS Capacitor/Diode Properties | Specification | Optimum |
| ${}_{D}C/C_{D}VS_{LOPE}$ | 30-200%/V | 100%/V |
| $V_T$ | 0-3 V | 0 V |

Exemplary Methods for Making MOS EAS and/or RF Tag/Device Structures

In a further aspect, the present invention concerns a method for making a surveillance and/or identification device, generally as described herein. Further, the surveillance and/or identification device can be tuned by locating the inner inductor such that a resonant frequency of the outer inductor increases by a desired amount, relative to locating the inner inductor in the geometric center of the outer inductor (described in greater detail below). In a preferred embodiment, the depositing step comprises printing a liquid-phase Group IVA element precursor ink on the dielectric film. Printing an ink, as opposed to blanket deposition, photolithography and etching, saves on the number of processing steps, the length of time for the manufacturing process, and/or on the cost of materials and/or equipment used to manufacture the EAS device. Thus, the present method provides a cost-effective method for manufacturing nonlinear EAS devices.

A first exemplary method for manufacturing a single-coil EAS tag is described below with reference to FIGS. 2A-9B. This exemplary method may be used to form the non-linear RLC circuit of tag/device 100 shown in FIGS. 1A-1B (e.g., including nonlinear capacitor [having plates 10*a*-1 and 50-1] and inductor 10*a*-1 through 10*i*/*j*-1), and with the exception of steps used to form semiconductor layer(s) 30 and 35, steps similar or identical thereto may be used to form the linear RLC circuit of tag/device 100 shown in FIGS. 1A-1B (e.g., including linear capacitor [having plates 10*a*-2 and 50-2] and inductor 10*a*-2 through 10*i*/*j*-2).

The Substrate

Figure 2A:
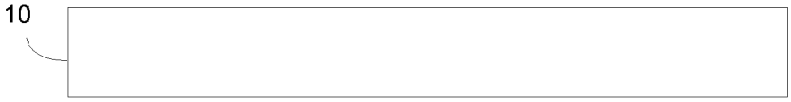
FIGS. 2A and 2B show cross-sectional and top views, respectively, of a conventional metal sheet or foil substrate.
Figure 2B:
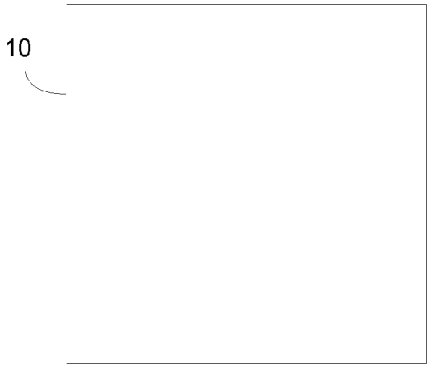

FIGS. 2A-2B respectively show cross-sectional and top-down views of an electrically functional substrate 10, which in various embodiments, comprises a metal sheet or metal foil (and in one embodiment, a thin aluminum sheet). Prior to subsequent processing, substrate 10 may be conventionally cleaned and smoothed. This surface preparation may be achieved by chemical polishing, electropolishing and/or oxide stripping to reduce surface roughness and remove low quality native oxides. A description of such processes is given in, "The Surface Treatment and Finishing of Aluminum and Its Alloys," by P. G. Sheasby and R. Pinner, sixth edition, ASM International, 2001, the relevant portions of which are incorporated herein by reference.

As described above, the metal sheet/foil may have a nominal thickness of 20-100 μm and/or a resistivity of 0.1-10 μohm-cm. A metal sheet/foil is advantageously used in the present method because it may be (1) electrochemically anodized to reproducibly and/or reliably provide a suitable dielectric film, (2) later formed into the inductor and lower capacitor plate, and/or (3) serve as a mechanically and/or physically stable substrate for device processing during the first part of the manufacturing process.

Forming the Dielectric Film

Figure 3A:
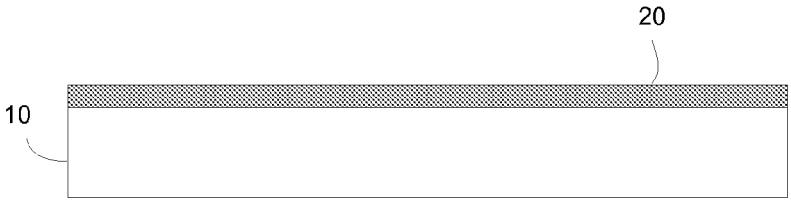
FIGS. 3A and 3B show cross-sectional and top views, respectively, of the aluminum sheet or foil substrate of FIGS. 2A-2B with a thin dielectric film on one surface.
Figure 3B:
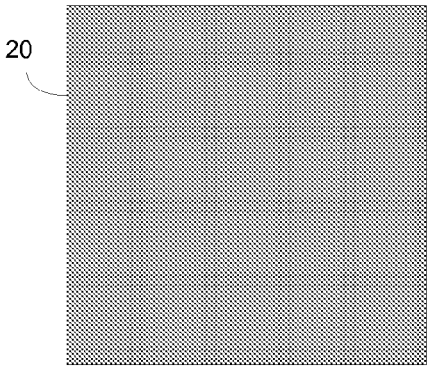

Referring now to FIGS. 3A-3B (which respectively show cross-sectional and top-down views), the method further comprises the step of forming a dielectric film 20 on the electrically functional substrate 10. In preferred embodiments, the dielectric film 20 has a thickness of from 50 to 500 Å and/or a breakdown voltage of from about 5V to less than 50V, preferably from 10V to 20V. In one implementation in which substrate 10 comprises or consists essentially of a metal sheet or metal foil, the step of forming the dielectric film comprises anodizing the metal sheet or metal foil. A thin anodized dielectric metal oxide film having a controlled breakdown in a voltage range preferably from about 10 to about 20V provides a reliable deactivation mechanism for the EAS tag.

Anodization to form a MOS dielectric and/or deactivation dielectric is a known process. A typical thickness for the dielectric film 20 is from 100 to 200 Å, which may correspond to a breakdown voltage in the above range, particularly when the dielectric film 20 consists essentially of aluminum oxide. In such electrochemical anodization, a rule of thumb is that one may obtain a thickness of 1.3 nm/V+2 nm (see *J. Appl. Phys*., Vol. 87, No. 11, 1 Jun. 2000, p. 7903, the relevant portions of which are incorporated herein by reference).

Barrier-type anodic oxide films are usually formed in dilute solutions of organic acids, like tartaric acid or citric acid, or in dilute solutions of inorganic salts or acids (for example, ammonium pentaborate or boric acid). Ethylene glycol may be mixed with water in those solutions, or even completely replace the water, as is often the case of a pentaborate salt. The pH of the electrolyte is usually adjusted to be between 5 and 7. The electrolytic bath is usually, but not exclusively, kept at room temperature. The Al foil or substrate is connected to the positive pole of a power supply (the anode) while the counter-electrode (usually a metal grid) is connected to the negative pole of the power supply (the cathode). Anodized films may be formed in a continuous and/or multi-step process. In an exemplary two step-process, during a first period of time, the voltage is increased at a constant current up to a voltage corresponding to about the desired thickness according to the formula: $V_{final}$=[desired thickness in nm]/1.2-1.4, where $V_{final}$ is the final voltage at the end of the first period of time. The constant current during this first phase may be from 10 microamps/cm$^2$ to 1 amp/cm$^2$, preferably from 100 microamps/cm$^2$ to 0.1 amp/cm$^2$. The rate of voltage increase may be from 0.1 to 100 V/min, preferably from about 10 to 50 V/min. In one implementation, the voltage increase rate is about 30 V/min. $V_{final}$ typically has a value at least that of the desired maximum breakdown voltage of the anodized film, and usually, about 1 to 2 times that desired maximum breakdown voltage. Then, during a second period of time, anodization current decreases while a constant voltage (equal to the final voltage from the first period of time) is maintained, during which period the dielectric properties are improved. The second period of time may be from 10 seconds to 60 minutes and in one implementation, about 15 min.

The dielectric breakdown voltage may be directly related to the voltage applied during the electrochemical anodization process to form the dielectric ($V_{final}$). For example, as discussed above, the breakdown voltage generally cannot exceed $V_{final}$. Typically, however, the breakdown voltage is from 50 to about 90% of $V_{final}$, more typically about 60 to about 80% of $V_{final}$. There may also be a relationship between the breakdown voltage and the current applied in the first phase of anodization, in that the higher the current, generally the closer the breakdown voltage comes to $V_{final}$.

Forming the Semiconductor Component

Referring now to FIGS. 4A-4B (which respectively show cross-sectional and top-down views of the EAS device), the method further comprises the step of depositing a semiconductor component 30 on the dielectric film 20. As described above, the component 30 may comprise any material that provides a nonlinear response to an RF field. In general, any method for depositing the semiconductor component material may be used, such as printing, or conventional blanket deposition (e.g., by chemical vapor deposition [CVD], low pressure CVD, sputtering, electroplating, spin coating, spray coating, etc.), photolithography and etching. Certain photopatternable functional materials that may have nonlinear properties, and methods for their deposition and use, are disclosed in copending U.S. application Ser. No. 10/749,876, filed Dec. 31, 2003, the relevant portions of which are incorporated herein by reference. Typical semiconductor component film thicknesses may be from 50 to 200 nm. The film thickness may be chosen to optimize (i) the maximum swing of the capacitance and/or (ii) the slope of the CV curve and the series resistance-limited frequency response of the EAS tag.

In preferred embodiments, semiconductor component 30 comprises a semiconductor material, such as one or more Group IVA elements (e.g., silicon and/or germanium), a so-called "III-V" material (e.g., GaAs), an organic or polymeric semiconductor, etc. Thus, in one implementation, depositing the semiconductor material or semiconductor material precursor comprises depositing a liquid-phase Group IVA element precursor ink on the dielectric film. Suitable liquid-phase Group IVA element precursor inks and methods for printing such inks are disclosed in copending U.S. application Ser. Nos. 10/616,147 and 10/789,317, respectively filed on Jul. 8, 2003 and Feb. 27, 2004, the relevant portions of each of which are incorporated herein by reference. Suitable liquid-phase doped Group IVA element precursor inks are disclosed in copending U.S. application Ser. Nos. 10/950,373 and 10/956,714, respectively filed on Sep. 24, 2004 and Oct. 1, 2004, and methods for printing or otherwise forming doped semiconductor thin films from such inks are disclosed in copending U.S. application Ser. No. 10/949,013, filed on Sep. 24, 2004, the relevant portions of each of which are incorporated herein by reference. Use of a precursor ink is advantageous in that the depositing step may thereby comprise printing the liquid-phase Group IVA element precursor ink on the dielectric film, as discussed above. Printing may comprise inkjet printing, microspotting, stenciling, stamping, syringe dispensing, pump dispensing, screen printing, gravure printing, offset printing, flexography, laser forward transfer, or local laser CVD.

When using a Group IVA element precursor ink, the step of forming the semiconductor component generally comprises curing the Group IVA element precursor, and may further comprise drying the liquid-phase Group IVA element precursor ink before curing the Group IVA element precursor. See copending U.S. application Ser. Nos. 10/616,147, 10/789,317, 10/789,274, and 10/949,013, respectively filed on Jul. 8, 2003, Feb. 27, 2004, Feb. 27, 2004 and Sep. 24, 2004, the relevant portions of each of which are incorporated herein by reference. Typically, although not necessarily always, the liquid-phase Group IVA element precursor ink further comprises a solvent, preferably a cycloalkane. In preferred implementations, the Group IVA element precursor comprises a compound of the formula $A_nH_{n+y}$, where n is from 3 to 12, each A is independently Si or Ge, and y is an even integer of from n to 2n+2, more preferably a compound of the formula $(AH_z)_n$, where n is from 5 to 10, each A is independently Si or Ge, and each of the n instances of z is independently 1 or 2. Use of local printing of a liquid semiconductor precursor, preferably a silane-based precursor to Si or doped Si (see, e.g., U.S. application Ser. Nos. 10/616,147, 10/789,317 and/or 10/949,013), directly onto dielectric film 20 to form part of an RF active MOS structure is cost effective due to efficient semiconductor precursor materials usage and the combination of deposition and patterning into one inexpensive printing step.

The semiconductor deposition process may also require UV or thermal curing processes to fix the layer and/or convert the precursor to an active semiconducting layer and/or remove unwanted precursor components or byproducts such as carbon (elemental carbon or a carbon-containing compound) or excess hydrogen (particularly if laser recrystallization is to be used immediately after semiconductor film formation). In such embodiments, the semiconductor or semiconductor precursor may be also deposited by spin coating with simultaneous irradiation, as disclosed in copending U.S. application Ser. No. 10/789,274, filed on Feb. 27, 2004 (the relevant portions of which are incorporated herein by reference), or by other techniques, including bath deposition. Furthermore, the semiconductor may be deposited by other processes including large area (e.g., blanket) or local sputtering, CVD, laser forward transfer, or other processes.

It is generally desirable to increase the frequency response of the MOS capacitor circuit on the EAS device and provide a low series resistance for the circuitry in the EAS device to enable high frequency operation (e.g., in the range of 125 kHz and above). To achieve sufficiently low series resistance and/or increased frequency response, one may recrystallize the semiconductor material used for the semiconductor component 30. Such recrystallization can improve the carrier mobility and/or dopant activation of the semiconductor. Mobilities approaching 10 $cm^2$/vs and higher may be required for low dissipation and/or effective high Q. Low dissipation generally requires low series resistance, preferably less than 5 Ohms for the entire circuit, along with a large parallel resistance (generally provided by a low leakage dielectric) of at least $10^4$ Ohms, preferably $\geqq 10^5$ Ohms, most preferably $>10^6$ Ohms. Effective high Q provides low field and/or high read range operation in MHz range frequencies and higher. Recrystallization may comprise irradiating with a laser sufficiently to recrystallize the semiconductor, heating at a temperature and time below the damage threshold of the metal sheet/film 10 but sufficient to recrystallize the semiconductor, and/or inducing or promoting semiconductor crystallization using a metal (e.g., Ni, Au, etc.) at a temperature generally lower than the semiconductor recrystallization temperature (e.g., 400° C. or less, 300° C. or less, or 250° C. or less).

Figure 7B:
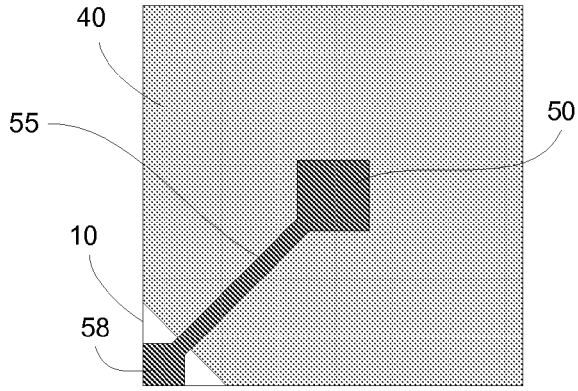

Heavily doping, or alternatively, siliciding the semiconductor material may also increase the frequency response of the EAS tag MOS capacitor circuit, and form a low resistance/barrier contact between the semiconductor component 30 and an electrode (e.g., upper capacitor plate 50 and electrode strap or conductor 55, shown in FIGS. 7A-7B). A doped semiconductor layer 35 (as shown, e.g., in FIGS. 1A, 5A and 5B) may be formed by conventionally implanting a conventional semiconductor dopant, diffusing such a dopant into the semiconductor material from a solid or vapor dopant source, by printing a doped semiconductor or semiconductor precursor such as a B- or P-containing (cyclo)silane (see copending U.S. application Ser. Nos. 10/616,147, 10/789,317, 10/950,373, 10/949,013, and 10/956,714, respectively filed Jul. 8, 2003, Feb. 27, 2004, Sep. 24, 2004, Sep. 24, 2004, and Oct. 1, 2004, the relevant portions of each of which are incorporated herein by reference), and/or by laser forward transfer of a doped semiconductor layer or dopant diffusion source layer. Referring now to FIGS. 5A-5B (which respectively show cross-sectional and top-down views of EAS device 200), a metal silicide or heavily doped semiconductor layer 35 may be formed on semiconductor component 30 by, e.g., blanket depositing a metal film, annealing to form the metal silicide, and removing the non-silicided metal by selective etching. Suitable metal silicides include titanium silicide, tungsten silicide, cobalt silicide, molybdenum silicide, and others.

Heavily doped or silicided contacts 35 between upper capacitor plate 50 and semiconductor layer 30 may also allow for improved ohmic contact and/or reduced contact resistance. The carrier concentration of the doped contact layer is preferably $>10^{18}$ $cm^{-3}$. This reduces the overall series resistance of the EAS device and results in higher Q and large relative capacitance changes for the MOS capacitor in the EAS device, as more voltage may be present across the active semiconductor region of the device. Thus, the present manufacturing method may further comprise printing a contact layer 35 onto the active silicon semiconductor layer 30 using, e.g., a silicon-containing ink further containing one or more dopants (see, in particular, copending U.S. application Ser. No. 10/949,013, filed Sep. 24, 2004, the relevant portions of which are incorporated herein by reference). This process step has the advantage of not requiring a high temperature diffusion and/or activation step. The dopant may be active upon curing the silicon precursor ink, or it may be activated by conventional thermal, optical, or laser annealing, including activation during a combined dopant activation and recrystallization step.

It may also be desirable to provide a relatively low level of doping (a concentration of $<5\times10^{18}$ $cm^{-3}$ electrically active dopant atoms) in the bulk of the active semiconductor layer 30 to control the CV slope of the device and also reduce the series resistance of the semiconductor component, thereby allowing higher Q and/or higher frequency operation. Simple RC calculations of the EAS device performance indicate that conductivities of the semiconductor component film 30 may need to be higher than $\sim2.5\times10^{-2}$ $\Omega^{-1}$ $cm^{-1}$ for device operation at a frequency of about 13.56 MHz. This may be achieved with (1) mobilities near 10 $cm^2$/vs and above and (2) electrically active doping levels of $\sim10^{17}$ $cm^{-3}$. (These calculations do not account for contact resistance and/or contact barriers, and actual conductivity requirements may be higher. For example, assuming a 0.5Ω contact resistance, the conductivity requirements would increase to approximately $4.5\times10^{-2}$ $\Omega^{-1}$ $cm^{-1}$, and the doping level would increase correspondingly.)

In addition, the semiconductor component may comprise a multilayer structure 30/35. For example, and continuing to refer to FIGS. 5A-5B, successive silane coating/curing processes may be used to form an $n^-$ doped silicon film 30 and an $n^+$ doped silicon film 35 thereon, an n-doped silicon film 30 and a p-doped silicon film 35 thereon or vice versa (each of which may comprise multiple layers of differing dopant concentrations, or which may have an intrinsic semiconductor layer between them) to form a conventional p-n, p-i-n or Schottky diode (in which case silicon film 35 may only partially overlie silicon film 30, and silicon film 30 may be in electrical communication with a second conductor and/or a second interconnect pad in electrical communication with conductor 55 or logic circuitry [not shown]), or more complex alternating n-doped and p-doped silicon films, etc.

Forming the Interlayer Dielectric

Referring now to FIGS. 6A-6B (which respectively show cross-sectional and top-down views of EAS device 200), the present method of manufacturing a surveillance and/or identification device may further comprise the step of depositing an interlayer dielectric (ILD) 40 on at least a part of the dielectric film 20. The ILD provides an electrical separation, in terms of leakage and capacitance, between the inductor 10*b*-10*i* and the top electrode strap 55 (see, e.g., FIGS. 7A and 9A), which may be highly desired and/or necessary for EAS tag operation.

In one embodiment, the step of depositing the interlayer dielectric 40 is performed after the step of forming the semiconductor component 30, and in an alternative embodiment (see FIGS. 10A-11B and the corresponding discussion thereof below), the step of depositing the interlayer dielectric 40 is performed before the step of forming the semiconductor component 30. In either case, the interlayer dielectric 40 may be blanket deposited over the entire device and selected portions thereof removed (e.g., by conventional photolithography and etching), or alternatively, interlayer dielectric 40 may be selectively deposited on one or more predetermined portions of dielectric film 20 (and, optionally, on one or more predetermined portions of semiconductor component 30 or upper semiconductor component layer 35) by, e.g., printing an interlayer dielectric precursor thereon. Also, in either case, the interlayer dielectric may have a thickness of at least one micron, preferably from 2 to 20 μm, more preferably from 5 to 10 μm.

In the case where the step of depositing the interlayer dielectric 40 is performed after the step of forming the semiconductor component 30, the interlayer dielectric 40 is also deposited on at least a part of the semiconductor component 30. In the case where the interlayer dielectric 40 is blanket deposited, the method generally further comprises the step of forming (a) a first via 45 in the interlayer dielectric 40 sufficient to expose at least part of the semiconductor component 30 or upper semiconductor component layer 35 and (b) a second via in the interlayer dielectric 40 (sufficient to expose at least part of the dielectric film 20 in a region corresponding to a linear capacitor or at least part of a second semiconductor component equivalent or identical to structures 30 and/or 35). The ILD via 45 also defines or partially defines the size of the MOS capacitor, as the areas outside of the via 45 covered by the electrode strap or conductor 55 (see, e.g., FIG. 7A) would be areas where the capacitance per unit area is very low, because of (i) the greater thickness of the ILD 40 compared to the dielectric film 20, and/or (ii) in preferred embodiments, a lower dielectric constant for the ILD 40 relative to the dielectric film 20 (a dielectric constant of 2-3 for a silicon dioxide ILD 40, as compared to 8.4 for aluminum oxide).

Thus, in some implementations, the step of depositing the interlayer dielectric 40 may comprise the steps of (i) printing a liquid-phase interlayer dielectric precursor ink on at least predetermined portions of the dielectric film 20, and (ii) drying and/or curing the interlayer dielectric precursor/ink to form the interlayer dielectric 40. The liquid-phase interlayer dielectric precursor ink may be printed on the dielectric film such that an opening 45 is formed into which the semiconductor component (preferably a Group IVA element or Group IVA element precursor) is subsequently deposited. Similar to the method for forming semiconductor component 30, the liquid-phase interlayer dielectric precursor ink may comprise a compound of the formula $A_nH_y$ where n is from 3 to 12, each A is independently Si or Ge, and y is an even integer of from n to 2n+2, and preferably a compound of the formula $(AH_z)_n$, where n is from 5 to 10, each A is independently Si or Ge, and each of the n instances of z is independently 1 or 2. In the case of the ILD 40, the corresponding silicon and/or germanium oxide film is formed by curing the Group IVA element precursor film in an oxidizing atmosphere (e.g., at a temperature of 300° C., 350° C. or 400° C. or more, but less than the melting temperature of the substrate 10, in the presence of oxygen, ozone, $N_2O$, $NO_2$, or other oxidizing gas, which may be diluted in an inert carrier gas such as nitrogen, argon or helium). Of course, the silane-based Si or $SiO_2$ precursor film (see, e.g., U.S. application Ser. Nos. 10/789,317, 10/789,274, 10/950,373, 10/949,013, and 10/956,714, respectively filed on Feb. 27, 2004, Feb. 27, 2004, Sep. 24, 2004, Sep. 24, 2004 and Oct. 1, 2004, the relevant portions of each of which are incorporated herein by reference) may also be blanket deposited and photolithographically etched.

Other solution-based dielectrics, including spin on glasses, organic dielectrics, etc., may be applied by printing or other conventional coating steps. Suitable ILD materials include spin on glasses (which may be photodefinable or non-photodefinable, in the latter case patterned by direct printing or post deposition lithography); polyimides (which may be photodefinable and/or thermally sensitized for thermal laser patterning, or non-photodefinable for patterning by direct printing or post deposition lithography); BCB or other organic dielectrics such as SiLK® dielectric material (SILK is a registered trademark of Dow Chemical Co., Midland, Mich.); low-k interlayer dielectrics formed by sol-gel techniques; plasma enhanced (PE) TEOS (i.e., $SiO_2$ formed by plasma-enhanced CVD of tetraethylorthosilicate); and laminated polymer films such as polyethylene (PE), polyester, or higher temperature polymers such as PES, polyimide or others that are compatible with subsequent high temperature processing.

Figure 9A:
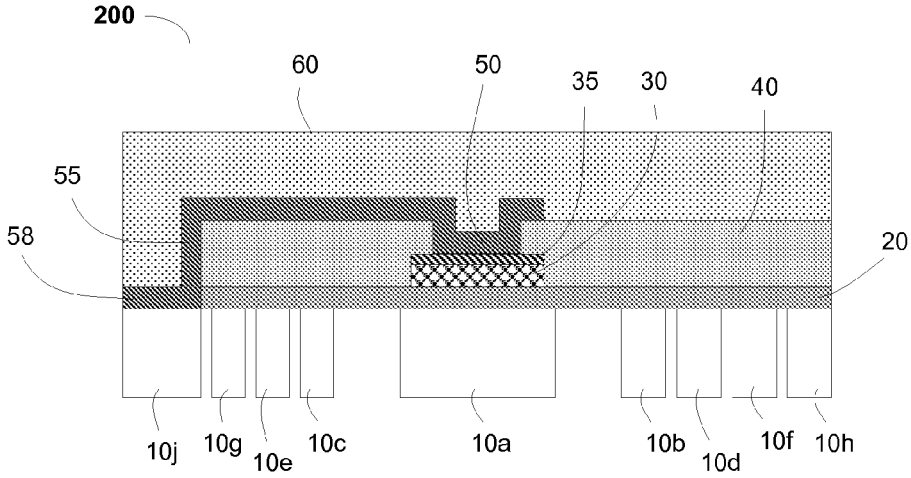
FIGS. 9A and 9B show cross-sectional and bottom views, respectively, of the structure of FIG. 8 with an inductor coil etched into the conventional metal foil or sheet of FIGS. 2A-2B.
Figure 9B:
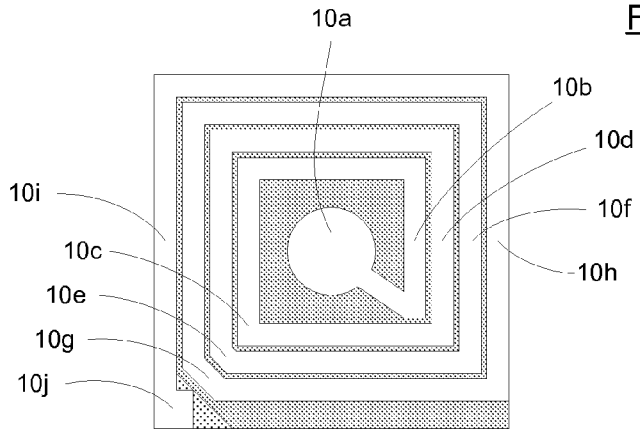
Figure 10A:
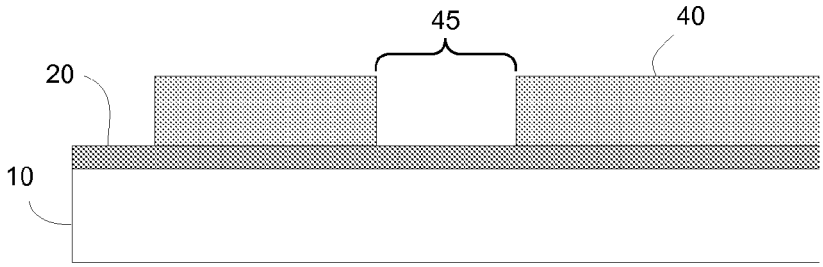
FIGS. 10A and 10B show cross-sectional and top views, respectively, of an alternative embodiment of the present invention in which the substrate of FIGS. 3A-3B has an interlayer dielectric thereon.
Figure 10B:
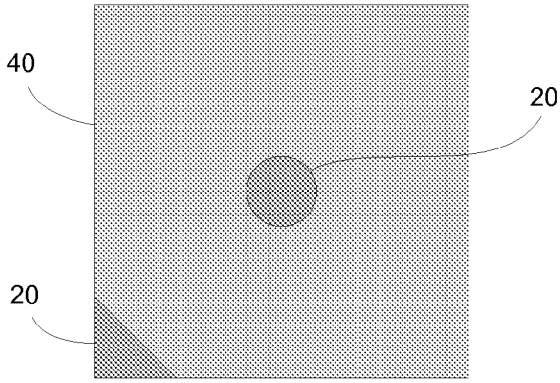

Additional vias or openings in ILD 40 are generally required to allow contact between the "pad" end 10*j* of the inductor coil 10*b*-10*i* and the interconnect pad 58 of the top electrode 55 (see, e.g., FIGS. 9A-9B). FIG. 1A shows multiple openings in the ILD 40 into which interconnect pads 58-1 and 58-2 and linear capacitor plate 50-2 are formed. The ILD 40 may be printed in a pattern providing for such contact, or the additional opening may be formed in a later etch step, which may be performed by laser ablation, mechanical penetration or other etching or dielectric removal technique. After ILD 40 is printed, defined and/or patterned, portion(s) of dielectric film 20 in region(s) corresponding to a linear capacitor are conventionally masked off, and exposed portions of dielectric film 20 are removed (typically by conventional wet or dry etching), optionally using ILD 40 (and semiconductor component 30/35) as a mask, then removing the mask material from the masked-off portions of dielectric film 20. For convenience in showing the interconnect structure at the lower left-hand corner of tag 200, FIG. 6A is a cross-sectional view of the tag 200 of FIG. 6B with the left-hand side showing the cross-section along the diagonal axis from the center of tag 200 to point A, and the right-hand side showing the cross-section along the axis from the center of tag 200 to point A'.

The process flow of FIGS. 3A-6B, with formation of ILD 40 following the deposition of semiconductor component 30, has some advantages, including the fact that silicon processing in semiconductor component formation, which may include high temperatures, UV irradiation and/or laser exposure, does not necessarily and/or directly affect the ILD 40, as the ILD 40 can be added after semiconductor component formation. The critical planar dimensions may be controlled by the conductor deposition process, the extent of a heavily doped contact layer that can define the effective area of the MOS capacitor, or by local recrystallization (where the lateral extent of the laser exposed regions controls the effective area, and therefore, the nominal capacitance of the device by limiting the active recrystallized and/or dopant activated region of the device). Also, as mentioned above, by using a via 45 smaller than the printed semiconductor component dimensions and thus positioning the active area of the MOS capacitor away from potentially detrimental edge regions, the impact of potentially detrimental edge effects can be reduced. It may also be possible to use a high precision printing technique, such as ink jet printing, syringe dispensing, stenciling, screen printing, aerosol jet printing, etc., to define the capacitor size by printing a top capacitor plate where the overall capacitance is partially or fully defined by the line width and/or resolution of the printed conductor feature (in this case, capacitor plate 50).

Blanket deposition of the ILD 40 may be done by extrusion, blade, dip, linear, spin or other coating technique, as well as by local deposition techniques such as printing or dispensing. In the case of printing or dispensing, this may also serve the purpose of patterning the ILD 40. Patterning of the ILD layer 40 may be done by direct printing of the ILD precursor materials (e.g., by inkjet printing, screen, gravure, flexography, laser forward transfer, etc.) or indirect patterning (such as with a photo- and/or thermo-patternable precursor material that is exposed by a photomask, thermal or laser pattern and developed, or extrinsically via a patterning process, such as conventional photolithography, embossing or similar technique).

Referring now to FIGS. 10A-11B, in another version of the manufacturing process, formation of the ILD 40 and via 45 may precede the deposition of the semiconductor component 30 and/or its associated contact/doping/silicide layer(s) 35. This alternative process has the advantage that the surface energy and/or physical pattern of the ILD 40 may direct or pattern the features of a printed semiconductor component 30, thereby controlling the physical dimensions of the non-linear device. This alternative may also avoid the linear capacitor dielectric masking step described in paragraph above.

In this case, the physical steps and/or wetting properties of the ILD 40 versus the exposed area of the dielectric film 20 within via 45 may serve to pattern or otherwise control the extent to which the semiconductor component precursor solution is deposited or printed, thereby helping to control the tolerances of the circuitry on the EAS device 200. This can be particularly advantageous in non-swept EAS read systems, where the reader interrogation/power signal is fixed. In this case, the transponder's resonance must closely match that of the reader signal in order for good coupling to occur between the transponder and reader. Controlling the effective capacitor size through the patterning of the ILD 40 provides a means or mechanism for limiting the spread of the resonances of the tags (i.e., the tag-to-tag or lot-to-lot resonance frequency variation) due to manufacturing variations.

In this alternative process, the ILD 40 can define the effective size of the semiconductor component 30 (and, optionally, upper semiconductor component layer 35) and/or capacitor plate 50, and therefore control the tolerances for the capacitor size. This may have advantages where the processes for making or forming the nonlinear capacitor elements may be of relatively low placement or alignment accuracy (high speed printing, for instance). The ILD 40 is of sufficient thickness that the overlap capacitance formed between the top conductors 50/55 (including the capacitor plates and the strap) and the bottom conductors (including the bottom electrode plate 10*a*, inductor 10*b*-10*i*, and interconnect pad 10*j*) is not significant in comparison with the capacitance of the region contained within the ILD via 45.

However, in the version of the manufacturing process shown in FIGS. 4A-6B, the ILD 40 and ILD via 45 are formed after depositing the semiconductor component 30/35. Again, in this case, the extent of the high capacitance MOS active region is effectively defined by the size of via 45, and not the area of the printed semiconductor component 30/35. It may be advantageous for the via size to be significantly smaller than the semiconductor component size to reduce the impact of edge nonuniformities that may be present (e.g., edge drying effects, roughness, or chemical inhomogeneity that may occur at the edge of printed, solution-deposited, or etched semiconductor features).

Forming the Conductor

Referring now to FIGS. 7A-7B, the present method of manufacturing a surveillance and/or identification device generally comprises forming a conductive structure or electrode strap 55, generally configured to provide electrical communication between the semiconductor component 30/35 and substrate 10 (from which, as will be seen in FIGS. 9A-9B and discussed below, the EAS circuit inductor and bottom capacitor plate can be subsequently formed). In one implementation, the step of forming the conductor 55 comprises printing a conductor ink onto the semiconductor component 30/35 and at least part of the interlayer dielectric 40 (and optionally, onto at least part of the substrate 10). As for the semiconductor component-forming step(s), the step of forming the conductor may further comprise the step(s) of drying and/or curing the conductor ink. Alternatively, the step of forming the conductor comprises depositing the conductor onto semiconductor component 30/35, the interlayer dielectric, and exposed portion(s) of the substrate 10, and etching the conductor to form conductive structure 55 and upper capacitor plate 50. Thus, the method generally comprises the step(s) of (1) forming the conductive structure 50/55 such that it is in electrical communication with at least one of (and preferably both of) the semiconductor component 30/35 and the substrate 10, and/or (2) forming the conductive structure 50/55 after the semiconductor component 30.

In preferred implementations, the top electrode strap (e.g., conductor 55) further includes an interconnect pad 58 from the outside of the to-be-formed inductor coil 10*b*-10*i* (see, e.g., FIGS. 9A and 9B) and an upper, charge-injecting plate or electrode 50 of the MOS capacitor. Similar to the semiconductor element 30, the top electrode may be formed by printing (e.g., by inkjet printing, screen printing, syringe dispensing, micro-spotting, gravure printing, offset printing, flexographic printing or other printing method) one or more conducting inks or conducting ink precursors onto the upper surface of the structure of FIGS. 6A-6B in the pattern shown in FIG. 7B.

Inclusion of dopants, siliciding components, or other agents (e.g., work function modulation agents and/or tunneling barrier materials) into conductive structure 50 may reduce the series resistance and increase the Q and overall tag performance. Such series resistance reduction may comprise (i) one or more additives in the top electrode ink and/or (ii) depositing one or more interlayer material(s) (e.g., heavily doped layer 35) between the top electrode and the underlying semiconductor component 30.

Passivation

Figure 8:
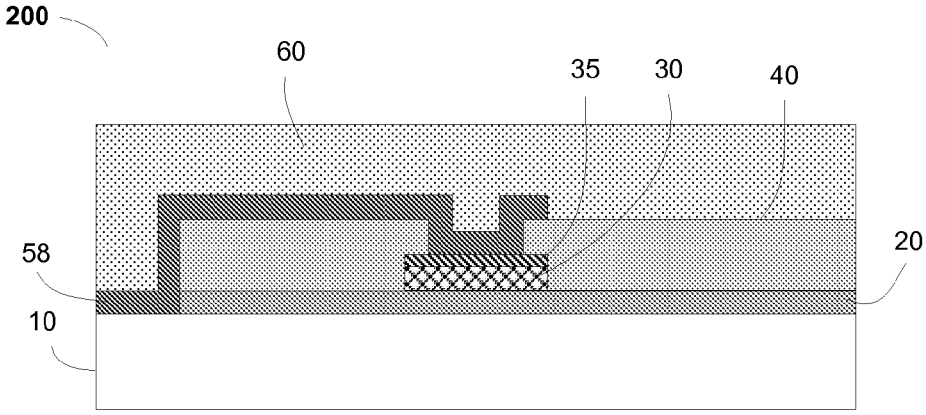
FIG. 8 shows a cross-sectional view of the substrate of FIGS. 7A-7B with a passivation layer thereon.

As shown in FIG. 8, after forming conductive structure 50, the present manufacturing method may further comprise the step of passivating (e.g., forming a passivation layer 60) over the interlayer dielectric 40 and the conductive structure 50 (and, when exposed, substrate 10). A passivation layer 60 generally adds mechanical support to the EAS device, particularly during the substrate etching process, and may prevent the ingress of water, oxygen, and/or other species that could cause the degradation or frequency drifting of device performance. The passivation layer 60 may be formed by conventionally coating the upper surface of the device 100 with one or more inorganic barrier layers such as a polysiloxane and/or a nitride, oxide and/or oxynitride of silicon and/or aluminum, and/or one or more organic barrier layers such as parylene, a fluorinated organic polymer (e.g., as described above), or other barrier material.

Forming the Inductor and/or Lower Capacitor Plate

FIGS. 9A-9B respectively show cross-sectional and bottom views of EAS device 100, in which substrate 10 has been patterned and etched to form lower capacitor plate 10*a*, inductor 10*b*-10*i* and interconnect area 10*j*. Thus, the present manufacturing method further comprises the step of etching the electrically functional substrate, preferably wherein the etching forms inner and outer inductor coils and/or first and second capacitor plates, such that at least one of the capacitor plates may be (i) capacitively coupled to a semiconductor component under one or more predetermined conditions (such as above the predetermined threshold voltage described above); and/or (ii) complementary to an upper capacitor plate formed as part of the conductive structure.

The substrate 10 (see FIG. 8) can be patterned by conventional photolithography, or by contact printing or laser patterning of a resist material applied to the backside (non-device side) of substrate 10. The substrate 10 can then be etched with standard wet (e.g., aqueous acid) or dry (e.g., chlorine, boron trichloride) etches to form the capacitor plates 10*a*-1, 10*a*-2 and/or 10*a*-3, inductors 10*b*-1 through 10*i*-1, 10*b*-2 through 10*i*-2 and/or 10*b*-3 through 10*i*-3, and interconnect pads 10*j*-1, 10*j*-2 and/or 10*j*-3 (see FIGS. 1A-1C). The patterning and/or etching steps may be thermally, optically or electrically assisted. The substrate 10 may also be patterned by direct means such as milling, laser cutting, stamping, or die-cutting.

A backing and/or support layer may be desired or required to provide mechanical stability and/or protection for the non-passivated side of the device 100 during later handling and/or processing. Thus, the present manufacturing method may further comprise the step of adding a support or backing to the etched electrically functional substrate. This backing layer may be added by lamination to paper or a flexible polymeric material (e.g., polyethylene, polypropylene, polyvinyl chloride, polytetrafluoroethylene, a polycarbonate, an electrically insulating polyimide, polystyrene, copolymers thereof, etc.) with the use of heat and/or an adhesive. Where the backing comprises an organic polymer, it is also possible to apply the backing layer from a liquid precursor by dip coating, extrusion coating or other thick film coating technology.

Exemplary Process Flow for Making Multi-Coil Devices

The following Table 2 contains a simplified example of a process flow for manufacturing a MOS capacitor tag using the inductor/bottom capacitor plate as the substrate. There are numerous other variants of this flow.

TABLE 2

Exemplary process flow.

| Module | Step | Process | Comment |
|---|---|---|---|
| Substrate Dielectric | Substrate form $Al_2O_3$ Pattern $Al_2O_3$ | <100 um Al sheet anodize Al- > $Al_2O_3$ low resolution resist | 25-100 μm Al foil/ sheet 100-200 Å oxide May be used to define a 100 μm (or greater) strap to inductor contact area |
| Si | Silane print/ polymerize | inkjet print + UV irradiation, slot coat + UV irradiation | |
| | Silane-Si conversion | Laser, flash oven anneal, RTA, | Typical anneal at 400-450° C. for 20 min in inert atmosphere |
| | Recrystallization and/or Dopant activation | Laser or flash lamp anneal | Pulsed excimer laser recrystallization and dopant activation is preferred for liquid silane-derived Si. |
| | Doped contact layer | Deposition or diffusion from solid or vapor source | Rc < 10 Ohm, <1 Ohm preferably |
| | Recrystallization and/or Dopant activation | Laser or flash lamp anneal | Pulsed excimer laser recrystallization and dopant activation has been demonstrated for liquid-silane derived Si. |
| ILD | planarize/ILD | polyimide/ photopolymer/ SOG coat | About 1-10 μm thickness preferred to minimize top electrode/ strap overlap parasitic capacitance |
| | Pattern ILD | Laser pattern, photo pattern | Pattern feature size~ 100-1000 μm |
| Top Electrode/ Strap | Deposit top electrode metal | Sputter, IJP, screen, stencil, gravure, flexographic, aerosol, etc. | |
| | Pattern top metal | contact/laser pattern resist | 5-20 μm, depending on strap line width and metal conductivity. |
| | Etch top metal | web bath etch | If required; may be useful to laminate or coat the substrate bottom surface to prevent undesired etching |
| Passivate/ laminate | Top surface passivation; laminate to support/ provide protective backing | laminate/extrude/ spray | Etch resistance during inductor coil etch, may provide mechanical stability |
| Inductor | Inductor pattern | web contact print, laser resist | contact printer, Creo, AGFA, DNS, etc. |
| | Inductor Etch | web bath etch | |

The starting substrate may be a sheet of Al foil of thickness of about 50-100 μm. The foil may be electropolished and/or anodized (e.g., in web form) to form a thin (about 5-50 nm) alumina layer on one or both sides of the foil. A positive-tone photo-sensitive spin-on-dielectric (SOD) layer may be coated over the entire web, exposed through a mask, and developed to form four openings or via holes in the SOD layer (but not the alumina layer). One or more liquid silicon film precursors (e.g., a cyclosilane of the formula $(SiH_2)_n$, where n=4-8 and which may be doped (see, e.g., copending U.S. application Ser. Nos. 10/616,147, 10/789,317, 10/950,373, 10/949,013, and/or 10/956,714, respectively filed on Jul. 8, 2003, Feb. 27, 2004, Sep. 24, 2004, Sep. 24, 2004 and Oct. 1, 2004, the relevant portions of which are incorporated herein by reference) or vacuum processed silicon may be deposited into the center opening and cured.

In FIG. 1A, the opening or via hole in the SOD layer corresponding to the linear capacitor in the outer coil may be masked off (optionally, along with the silicon film for the nonlinear capacitor), and the exposed alumina layer can be etched to expose the underlying Al foil. Two metal straps (e.g., including capacitor plates 50-1 and 50-2, conductors or electrode straps 55-1 and 55-2, and interconnect pads 58-1 and 58-2) may be deposited in liquid form by screen or inkjet printing a suitable ink, then cured to electrically connect the adjacent pairs of via holes. The foil can then be laminated to an adhesive backed polymer, such as PET or plasma enhanced (PE) TEOS (i.e., $SiO_2$ formed by plasma-enhanced CVD of tetraethylorthosilicate) to protect the silicon and straps. A relevant description and example(s) of processes similar to this one for making a (printed) nonlinear EAS tag is provided in U.S. application Ser. No. 10/885,283, filed on Jul. 6, 2004, the relevant portions of which are incorporated herein by reference. Both coils, which may be substantially concentric and coplanar, can then be simultaneously embossed, stamped, and/or etched from the backside of the foil.

In alternative embodiments, more than one location in the SOD can be opened for capacitor plates. Such openings can have virtually any shape (e.g., circular, square, rectangular, etc.), and the silicon island/plate (e.g., semiconductor components 30 and/or 35, along with capacitor plate 50-1) can be deposited into any one of the via holes. If the silicon island/plate is in one of the inner holes (i.e., electrically coupled to the inner coil), forming a nonlinear capacitor, the inner RLC circuit will be the active one. If the silicon island/plate is deposited in one of the outer holes (i.e., electrically coupled to the outer coil), forming a nonlinear capacitor, the outer RLC circuit will be the active one. In one implementation, a configuration having the inner circuit active has been shown to provide about 10 times better sensitivity.

In another alternative embodiment, the inner and/or outer coil can consist of as little as a single turn or loop. In one implementation where the inner coil consisted of one turn while the outer coil consisted of turns over the range of 1-5 turns, sensitivity has been shown to remain substantially constant where the inner coil is active, provided the Q of the outer coil is maintained relatively constant.

In another alternative embodiment, the two coils need not be concentric, but rather, the inner coil can be located in a position such that the geometric center of the inner coil is not coincident with the geometric center of the outer coil (e.g., "shifting" the position of the inner coil), to provide tuning of the outer circuit resonant frequency, as will be described in more detail below with reference to FIGS. 13A and 13B. Tuning can be implemented essentially using a "feed-forward" manufacturing flow and an interactive laser exposure process that exposes a photoresist used as a mask for the back side etch of the coil (e.g., the Al foil).

In another alternative embodiment, multiple circuits, both active and passive, can be formed on coils that are either all concentric, or arranged such that the small coils couple strongly with the larger outer coil, but not strongly with other small coils. This will be discussed in more detail below with reference to FIG. 1C.

In another alternative embodiment, the line widths and/or spacing between lines can be varied for the inner and/or outer coils. For example, a reasonable range of line widths may be about 0.5-2.0 mm, and of spacing between lines about 0.2-1 mm.

An Exemplary Method of Tracking Articles Using the Present EAS and/or RF Tags/Devices The present invention further relates to a method of detecting an item or object in a detection zone comprising the steps of (a) causing or inducing a current in the present device sufficient for the device to radiate detectable electromagnetic radiation (preferably at a frequency that is an integer multiple or an integer divisor of an applied electromagnetic field), (b) detecting the detectable electromagnetic radiation, and optionally, (c) selectively deactivating the device. Generally, currents and voltages are induced in the present device sufficient for the device to radiate detectable electromagnetic radiation when the device is in a detection zone comprising an oscillating electromagnetic field. This oscillating electromagnetic field is produced or generated by conventional EAS and/or RFID equipment and/or systems.

The present method of use may further comprise attaching, affixing or otherwise including the present device on or in an object or article to be detected. Furthermore, in accordance with an advantage of the present device, it may be deactivated by non-volatile shifting of the thresholds or capacitance of the device (i.e., shorting the two capacitor plates together) in response to an applied electromagnetic field having sufficient strength and an effective oscillating frequency to induce a current, voltage and/or resonance in the device. Typically, the device is deactivated when the presence of the object or article in the detection zone is not to be detected or otherwise known.

The use of electronic article surveillance or security systems for detecting and preventing theft or unauthorized removal of articles or goods from retail establishments and/or other facilities, such as libraries, has become widespread. In general, EAS systems employ a label or security tag, also known as an EAS tag, which is affixed to, associated with, or otherwise secured to an article or item to be protected or its packaging. Security tags may have many different sizes, shapes and forms, depending on the particular type of security system in use, the type and size of the article, etc. In general, such security systems are employed for detecting the presence or absence of an active security tag as the security tag and the protected article to which it is affixed pass through a security or surveillance zone or pass by or near a security checkpoint or surveillance station.

The present tags are designed at least in part to work with electronic security systems that sense disturbances in radio frequency (RF) electromagnetic fields. Such electronic security systems generally establish an electromagnetic field in a controlled area defined by portals through which articles must pass in leaving the controlled premises (e.g., a retail store). A tag having a resonant circuit is attached to each article, and the presence of the tag circuit in the controlled area is sensed by a receiving system to denote the unauthorized removal of an article. The tag circuit may be deactivated, detuned or removed by authorized personnel from any article authorized to leave the premises to permit passage of the article through the controlled area equipped with alarm activation. Most of the tags that operate on this principle are single-use or disposable tags, and are therefore designed to be produced at low cost in very large volumes.

The present tags may be used (and, if desired and/or applicable, re-used) in any commercial EAS and/or RFID application and in essentially any frequency range for such applications. For example, the present tags may be used at the frequencies, and in the fields and/or ranges, described in Table 3 below:

TABLE 3

Exemplary applications.

| Frequencies | Preferred Frequencies | Range/Field of Detection/ Response | Preferred Range/Field of Detection/ Response | Exemplary Commercial Application(s) |
|---|---|---|---|---|
| 100-150 kHz | 125-134 kHz | up to 10 feet | up to 5 feet | animal ID, car anti-theft systems, beer keg tracking |
| about 13.56 MHz | 13.56 MHz | up to 10 feet | up to 5 feet | inventory tracking (e.g., libraries, apparel, auto/ motorcycle parts), building security/access |
| 800-1000 MHz | 868-928 MHz | up to 30 feet | up to 18 feet | pallet and shipping container tracking, shipyard container tracking |
| 2.4-2.5 GHz | about 2.45 GHz | up to 30 feet | up to 20 feet | auto toll tags |

Deactivation methods generally incorporate remote electronic deactivation of a resonant tag circuit such that the deactivated tag can remain on an article properly leaving the premises. Examples of such deactivation systems are described in U.S. Pat. Nos. 4,728,938 and 5,081,445, the relevant portions of each of which are incorporated herein by reference. Electronic deactivation of a resonant security tag involves changing or destroying the detection frequency resonance so that the security tag is no longer detected as an active security tag by the security system. There are many methods available for achieving electronic deactivation. In general, however, the known methods involve either short circuiting a portion of the resonant circuit or creating an open circuit within some portion of the resonant circuit to either spoil the Q of the circuit or shift the resonant frequency out of the frequency range of the detection system, or both.

At energy levels that are typically higher than the detecting signal, but generally within FCC regulations, the deactivation apparatus induces a voltage in the resonant circuit of the tag 100 sufficient to cause the dielectric film 20 between the lower capacitor plate **10*a*-1 and semiconductor component 30/35 to break down. Thus, the present EAS tag 100** can be conveniently deactivated at a checkout counter or other similar location by momentarily placing the tag above or near the deactivation apparatus.

The present invention thus also pertains to article surveillance techniques wherein electromagnetic waves are transmitted into an area of the premises being protected at a fundamental frequency (e.g., 13.56 MHz), and the unauthorized presence of articles in the area is sensed by reception and detection of electromagnetic radiation emitted by the present EAS device 100. This emitted electromagnetic radiation may comprise second harmonic or subsequent harmonic frequency waves reradiated from sensor-emitter elements, labels, or films comprising the present EAS device that have been attached to or embedded in the articles, under circumstances in which the labels or films have not been deactivated for authorized removal from the premises.

A method of article surveillance or theft detection according to one aspect of the present invention may be understood with the following description of the sequential steps utilized. The present EAS tag 100 (for example, formed integrally with a price label) is attached to or embedded in an item, article or object that may be under system surveillance. Next, any active EAS tags 100 on articles that have been paid for or otherwise authorized for removal from the surveillance area may be deactivated or desensitized by a deactivation apparatus operator (e.g., a checkout clerk or guard) monitoring the premises. Thereafter, harmonic frequency emissions or reradiation signals or electromagnetic waves or energy from tags 100 that have not been deactivated or desensitized are detected as they are moved through a detection zone (e.g., an exit or verification area) in which a fundamental frequency electromagnetic wave or electrical space energy field is present. The detection of harmonic signals in this area signifies the unauthorized presence or attempted removal of unverified articles with active tags 100 thereon, and may be used to signal or trigger an alarm or to lock exit doors or turnstiles. While the detection of tag signals at a frequency of 2× or ½ the carrier or reader transmit frequency represents a preferred form of the method of use, other harmonic signals, such as third and subsequent harmonic signals, as well as fundamental and other subharmonic signals, may be employed.

Methods of Tuning MOS EAS and/or RF Tags/Devices

According to aspects of embodiments of the present invention, methods for tuning an RLC circuit in an EAS/RF tag include: (1) forming or inserting a conducting plug of appropriate size in the core of the inductor coil; (2) forming or inserting a conducting ring of appropriate size in the core of the inductor coil; (3) forming or inserting a second resonant circuit in the core of the inductor coil; (4) shifting the position of the plug, ring, or second resonant circuit from the center to the edge of the coil; and (5) shifting the resonant frequency of the outer circuit.

Figure 12A:
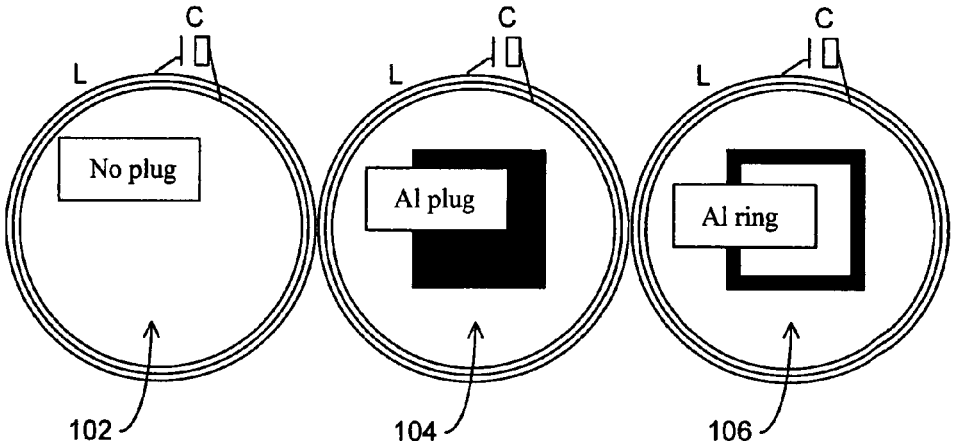
FIG. 12A shows RLC circuit tuning alternatives according to embodiments of the present invention, including no plug, plug, and ring placements within the inductor coil.

Referring now to FIG. 12A, RLC circuit tuning alternatives according to embodiments of the present invention, including no plug, plug, and ring placements within the inductor coil are shown. In each of the three alternatives shown, capacitor C and inductor coil L are substantially the same. In arrangement 102, no plug or ring is placed within the inductor coil. In arrangement 104, an aluminum "plug" may be placed within the inductor coil, as shown. In arrangement 106, an Al ring may be placed within the inductor coil, as shown.

Figure 12B:
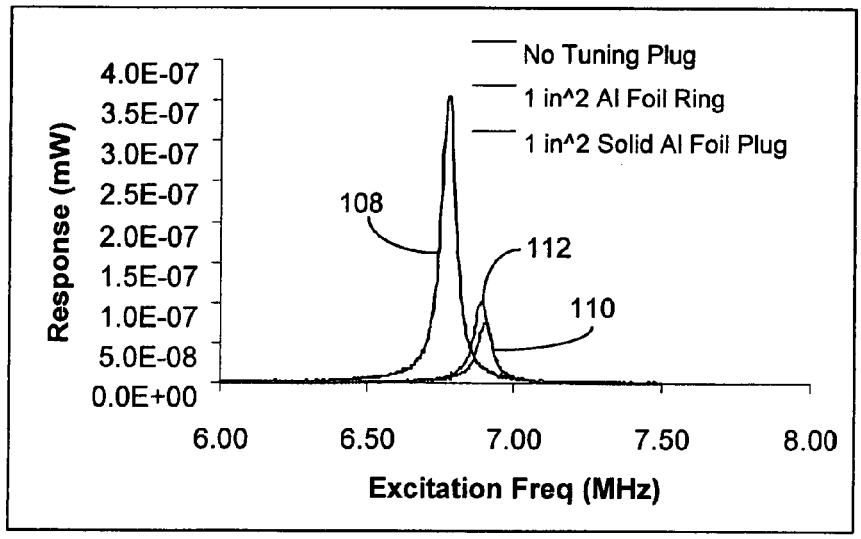
FIG. 12B shows waveform activity corresponding to implementations for each of the alternatives according to FIG. 12A.

Referring now to FIG. 12B, waveform activity corresponding to implementations for each of the alternatives according to FIG. 12A is shown. Waveform 108 shows a response where no plug or ring is placed within the inductor coil (e.g., arrangement 102 of FIG. 12A). Waveform 110 shows a different response for the arrangement where a solid Al foil plug is formed or placed within the inductor coil (e.g., arrangement 104 of FIG. 12A). Waveform 112 shows another different response for the arrangement where a ring of Al foil is formed or placed within the inductor coil (e.g., arrangement 106 of FIG. 12A). In this fashion, the resonant frequency of an RLC circuit can be tuned by placing a plug or a ring within the inductor coil. Further, the relative position of such a plug or ring with respect to the center of the inductor coil can also affect the resonant frequency.

Figure 13A:
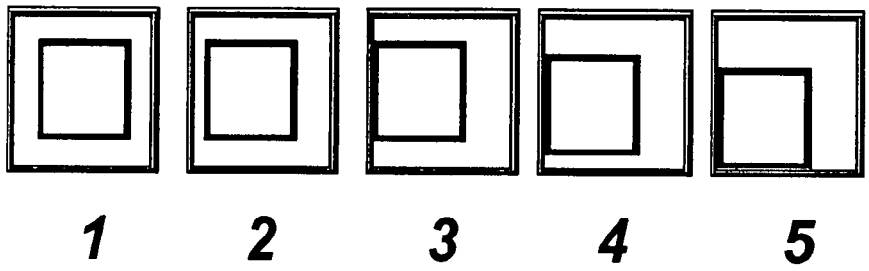
FIG. 13A shows inner RLC circuit relative placement alternatives for tuning according to embodiments of the present invention.

Referring now to FIG. 13A, inner RLC circuit relative placement alternatives for tuning according to embodiments of the present invention is shown. In position 1, the inner RLC circuit may be placed substantially in the center of the outer RLC circuit or inductor coil. In position 2, the inner RLC circuit may be shifted or placed left of the center of the outer RLC circuit or inductor coil. In position 3, the inner RLC circuit may be shifted or placed farther left of the center of the outer RLC circuit or inductor coil. In position 4, the inner RLC circuit may be shifted or placed to the left and down relative to the center of the outer RLC circuit or inductor coil. Finally, in position 5, the inner RLC circuit may be shifted or placed substantially left and down relative to the center of the outer RLC circuit or inductor coil.

Figure 13B:
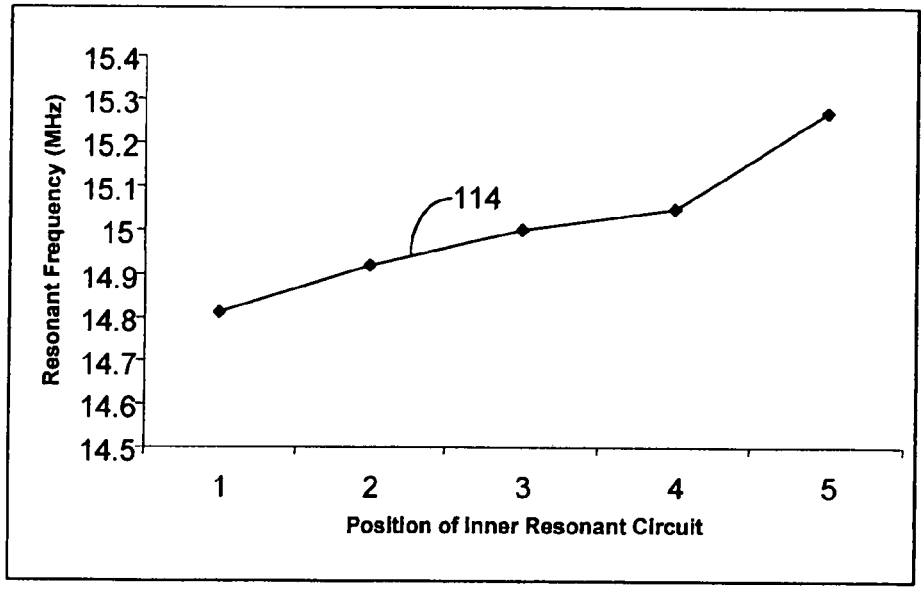
FIG. 13B shows resonant frequency measurements corresponding to implementations for each of the alternatives according to FIG. 13A.

Referring now to FIG. 13B, resonant frequency measurements corresponding to implementations for each of the alternatives according to FIG. 13A is shown (114). In this fashion, the resonant frequency of an RLC circuit in an EAS/RF tag can be tuned by varying the placement of an inner RLC circuit relative to an outer RLC circuit.

Figure 14:
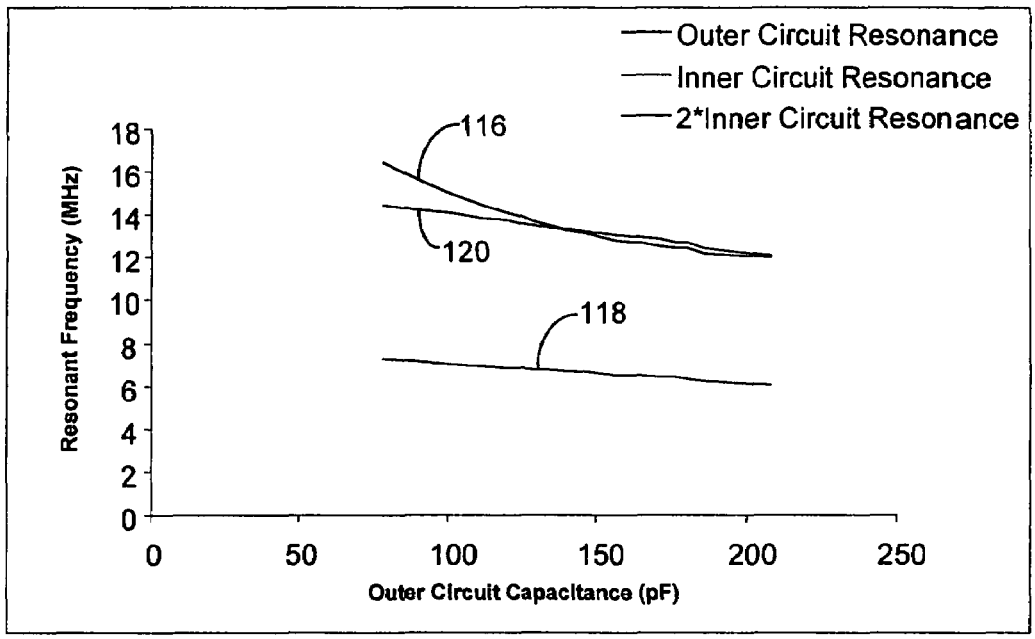
FIG. 14 shows resonant frequency measurements for a shifting of the resonant frequency of the inner RLC circuit by changing the capacitance of the outer circuit, according to an embodiment of the present invention.

FIG. 14 shows resonant frequency measurements for shifting the resonant frequency of the inner RLC circuit by changing the capacitance of the outer circuit, according to an embodiment of the present invention. Curve 116 shows the outer circuit resonant frequency change as a function of the outer circuit capacitance. Curve 118 shows a shift or change in the resonant frequency of the inner RLC circuit as a function of the outer circuit capacitance. So, an increase in the outer circuit capacitance reduces the resonant frequency of the inner RLC circuit. Curve 120 is a curve of twice the resonant frequency value of the inner RLC circuit. In this fashion, the resonant frequency of an RLC circuit in an EAS/RF tag can be tuned by changing the capacitance, and consequently changing the resonant frequency, of the outer RLC circuit. Alternatively, the inductance of the outer RLC circuit may be changed in order to have a similar effect on the inner RLC circuit resonant frequency.

Exemplary Triple Coil MOS EAS for Improved Manufacturing Tolerance

Referring back to FIG. 1C, such a triple coil EAS tag design may be used for improved manufacturing tolerance. By making the inner RLC circuit capacitances (C1 for the first inner RLC circuit and C2 for the second inner RLC circuit) linear type and the outer RLC circuit capacitance nonlinear type, the two inner circuits may be passive and the outer circuit may be active, for example. The first inner passive circuit can be tuned to resonate at frequency F1 by adjusting L1 and C1, as is known in the art. Similarly, the second inner passive circuit may be tuned to resonate at frequency F2. If the fixed frequency of the RF reader system is set at F0 (i.e., the carrier or reader frequency), then F1 and F2 can be manufactured so that they fall into ranges as shown in the following formulas (2) and (3):

$$F0<F1<(1.1*F0) \quad (2)$$

$$(0.9*F0)<F2<F0 \quad (3)$$

Here, the values of 1.1 and 0.9 used in these equations depend somewhat on the Q of the resonance and on the slope of the capacitance transition of the active circuit(s), which will be discussed in more detail below. Also, it is easier to control the relative values of the LC product rather than the absolute L and C values in a typical manufacturing environment. This is because these circuits are in close proximity to each other and are fabricated substantially simultaneously. Thus, process variations may cause the values 1.1 and 0.9 to drift up to, e.g., 1.22 and 1.0 or down to, e.g., 1.0 and 0.82, but the ratio (1.1/0.9) will typically remain constant.

The outer active coil may generally be manufactured such that its resonant frequency, F3, falls in a range, as indicated by the following formula (4):

$$(0.9*F0)<(2*F3)<(1.1*F0) \quad (4)$$

The frequency of F3 is not likely to be coupled to F1 or F2, nor is it necessary. Also, as formula (4) above indicates, 2*F3 is expected to fall within +/−10% of the reader frequency (F0), since this tag operates by generating a reradiated signal that is half the frequency of the reader frequency, as is well known in the art and also described above.

An alternate embodiment of the present invention includes three concentric circuits, where the active circuit(s) may be the inner circuit, the middle circuit, the outer circuit, or any two of these three concentric circuits. Similarly, the higher frequency passive circuit can be the inner, middle or outer coil, for example.

One reason designs according to embodiments of the present invention are able to improve manufacturing tolerances is because the passive circuits, which are roughly tuned to the reader frequency, are able to store energy near resonance in proportion to their Q. This stored energy causes a significant boost in the magnetic flux (≧10×, compared to flux from the reader system itself) through the passive circuits at frequencies up about +/−10% offset from the center of the resonance. This boosted flux then can cause the active circuit to begin resonating at its resonant frequency F3 at lower fields than would normally induce F3 oscillation in the absence of a booster (such as the inner active circuits). The use of two passive booster circuits, which are offset in resonance from each other, effectively expands the resonance range over which the active circuit can be manufactured. In one implementation according to embodiments of the present invention, a multiple (e.g., triple) coil design may permit the LC product tolerance to be expanded to roughly 20% during manufacturing because the RLC circuit can be tuned (i.e., have its resonant frequency adjusted) after the manufacturing process is complete.

An alternative embodiment of the present invention includes the use of four circuits, three of which are passive and each of which is 10% offset in resonant frequency relative to F3. Concentric coils, or a one outer/three inner coil design, can be employed. As one skilled in the art will recognize, this concept can be extended to even more coils.

CONCLUSION/SUMMARY

The present multi-coil circuit has been demonstrated with L, C, turn numbers, and size parameters that are reasonably manufacturable using coplanar, concentric foil designs. Functionality has been demonstrated in the two-bit EAS tags described above, as shown in the response-as-a-function-of-frequency data shown above, and for the methods of tuning an RLC circuit in an EAS/RF tag, as shown in the resonant frequency-as-a-function of inner coil location data presented above.

The present invention advantageously provides a low cost EAS, RF and/or RFID tag having increased detection range using two or more RLC circuits, more than one bit of write-once memory capability, and resonant frequency tuning after assembly.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A surveillance and/or identification device, comprising:

a) an outer inductor having a first end coupled to a first plate of a first capacitor;

b) an inner inductor having a first end coupled to a first plate of a second capacitor;

c) a dielectric film on said outer inductor, said inner inductor, said first plate of said first capacitor and said first plate of said second capacitor, the first dielectric film having openings therein exposing second ends of each of the outer and inner inductors;

d) a second plate of the first capacitor on the dielectric film, capacitively coupled to the first plate of the first capacitor;

e) a second plate of the second capacitor on the dielectric film, capacitively coupled to the first plate of the second capacitor;

f) a first conducting strap, configured to electrically connect a second end of the outer inductor to the second plate of the first capacitor; and g) a second conducting strap, configured to electrically connect a second end of the inner inductor to the second plate of the second capacitor.

2. The surveillance and/or identification device of claim 1, wherein one of said second capacitor plates comprises a semiconductor component on said dielectric film.

3. The surveillance and/or identification device of claim 2, wherein said second capacitor plate of the second capacitor comprises said semiconductor component.

4. The surveillance and/or identification device of claim 1, wherein said outer inductor and said inner inductor are coplanar.

5. The surveillance and/or identification device of claim 1, wherein said outer inductor and said inner inductor are concentric.

6. The surveillance and/or identification device of claim 1, further comprising a second inner inductor having a first end coupled to a first plate of a third capacitor and a second end coupled to a third conducting strap, said third conducting strap being coupled to a second plate of said third capacitor, said second plate of said third capacitor being on said first dielectric film.

7. The surveillance and/or identification device of claim 2, wherein said semiconductor component comprises silicon and/or germanium.

8. The surveillance and/or identification device of claim 1, wherein said outer inductor, said inner inductor, and each of said first capacitor plates comprise a first metal, and said dielectric film comprises a corresponding oxide of said first metal.

9. A method for making a surveillance and/or identification device, comprising the steps of:

a) forming a semiconductor component on a first dielectric film, said first dielectric film being on an electrically functional substrate;

b) forming a second dielectric film on the first dielectric film and the semiconducting component, the second dielectric film having holes therein to facilitate electrical connection to the semiconductor component and the substrate;

c) forming a plurality of conductive structures, a first one of which is at least partly on said semiconductor component and which comprises a first electrically conducting strap configured to provide electrical communication between said semiconductor component and said electrically functional substrate, and a second one of which comprises a second electrically conducting strap configured to provide electrical communication between a linear capacitor plate and the electrically functional substrate; and d) etching said electrically functional substrate to form an inner inductor and an outer inductor.

10. The method of claim 9, wherein said etching further forms a plurality of capacitor plates, each coupled at one end of a respective inductor.

11. The method of claim 9, wherein said etching forms a plurality of inner inductors.

12. The method of claim 9, wherein said semiconductor component comprises silicon and/or germanium.

13. The method of claim 12, wherein forming the semiconductor component comprises printing a liquid-phase silicon and/or germanium precursor ink on said dielectric film, drying the ink, and converting the silicon and/or germanium precursor to the semiconductor component.

14. The method of claim 9, wherein said electrically functional substrate comprises a stainless steel sheet or foil.

15. The method of claim 9, wherein said step of forming said plurality of conductive structures comprises printing a conductor ink onto said second dielectric film and said semiconductor component.

16. A method for making a surveillance and/or identification device from an electrically functional substrate having a first dielectric film thereon, comprising the steps of:

a) forming a second dielectric film on the first dielectric film, the second dielectric film having holes therein to facilitate formation of structures electrically connected and/or capacitively coupled to the electrically functional substrate;

b) forming a semiconductor component in at least one of said holes;

c) forming a plurality of conductive structures, a first one of which is at least partly on said semiconductor component and which comprises a first electrically conducting strap configured to provide electrical communication between said semiconductor component and said electrically functional substrate, and a second one of which comprises a second electrically conducting strap configured to provide electrical communication between a linear capacitor plate and the electrically functional substrate; and d) etching said electrically functional substrate to form an inner inductor and an outer inductor.

17. A method of detecting an item, comprising the steps of:

a) attaching, affixing or including the surveillance and/or identification device of claim 1 on or in said item;

b) causing or inducing a current in the surveillance and/or identification device sufficient for the device to radiate detectable electromagnetic radiation;

c) detecting said detectable electromagnetic radiation; and d) optionally, selectively deactivating said device.

18. An electronic article surveillance device, comprising:

a) a first inner circuit having a first inductor coupled to a first capacitor, said first inner circuit being configured to resonate at a first frequency, said first inner circuit configured to be deactivated at an integer multiple of said first frequency;

b) a second inner circuit having a second inductor coupled to a second capacitor, said second inner circuit being configured to resonate at a second frequency, said second inner circuit configured to be deactivated at an integer multiple of said second resonant frequency; and c) an outer circuit having a third inductor coupled to a third capacitor, said third inductor surrounding and substantially coplanar with said first and second circuits.

19. The electronic article surveillance device of claim 18, wherein said first and second capacitors are nonlinear capacitors and said third capacitor is a linear capacitor.

20. The electronic article surveillance device of claim 18, wherein said outer circuit is tuned to a third resonant frequency.

21. A method of tuning an electronic article surveillance device, comprising:

a) forming a conductive structure configured to provide electrical communication between a capacitor plate of said device and an electrically functional substrate; and b) etching said electrically functional substrate to form an inductor and an electromagnetically active inner plug or ring, said inner plug or ring having dimensions and/or a location sufficient to shift a resonant frequency of the inductor relative to locating said inner plug or ring in the geometric center of the outer inductor.

22. A method of tuning an electronic article surveillance device, comprising:

a) the method of claim 9; and b) locating said inner inductor such that a resonant frequency of the outer inductor increases by a predetermined and/or desired amount, relative to locating said inner inductor in the geometric center of the outer inductor.

23. The method of claim 22, wherein the outer inductor has first substantially linear portions along a first axis and second substantially linear portions along a second axis substantially perpendicular to the first axis, and the resonant frequency of the outer inductor increases by (i) a first predetermined amount when the inner inductor is located closer to one of the first or second substantially linear portions along an axis parallel to one of the first and second axes and by (ii) a second predetermined amount when the inner inductor is located closer to both of the first and second substantially linear portions along axes parallel to both of the first and second axes, the second predetermined amount being greater than the first predetermined amount.

24. A method of tuning an electronic article surveillance device, comprising:

a) the method of claim 16; and b) locating said inner inductor such that a resonant frequency of the outer inductor increases by a predetermined and/or desired amount, relative to locating said inner inductor in the geometric center of the outer inductor.

25. The method of claim 24, wherein the outer inductor has first substantially linear portions along a first axis and second substantially linear portions along a second axis substantially perpendicular to the first axis, and the resonant frequency of the outer inductor increases by (i) a first predetermined amount when the inner inductor is located closer to one of the first or second substantially linear portions along an axis parallel to one of the first and second axes and by (ii) a second predetermined amount when the inner inductor is located closer to both of the first and second substantially linear portions along axes parallel to both of the first and second axes, the second predetermined amount being greater than the first predetermined amount.

* * * * *